US009152088B1

(12) United States Patent
Kobori et al.

(10) Patent No.: US 9,152,088 B1
(45) Date of Patent: Oct. 6, 2015

(54) DEVELOPER REPLENISHING CARTRIDGE AND DEVELOPER REPLENISHING METHOD

(71) Applicant: CANON KABUSHIKI KAISHA, Tokyo (JP)

(72) Inventors: Takakuni Kobori, Toride (JP); Nozomu Komatsu, Toride (JP); Hideki Kaneko, Yokohama (JP); Takeshi Hashimoto, Moriya (JP); Ichiro Kanno, Abiko (JP); Yosuke Iwasaki, Abiko (JP); Hiroyuki Fujikawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/261,157

(22) Filed: Apr. 24, 2014

(30) Foreign Application Priority Data

May 1, 2013 (JP) ..... 2013-096482

(51) Int. Cl.
*G03G 15/08* (2006.01)

(52) U.S. Cl.
CPC ..... *G03G 15/0894* (2013.01); *G03G 15/0865* (2013.01)

(58) Field of Classification Search
None
See application file for complete search history.

(56) References Cited

U.S. PATENT DOCUMENTS

| | | | | |
|---|---|---|---|---|
| 2004/0013963 | A1 | 1/2004 | Muramatsu et al. | |
| 2008/0124643 | A1 | 5/2008 | Yoshiba et al. | |
| 2009/0155701 | A1 * | 6/2009 | Kim et al. | 430/48 |
| 2012/0014713 | A1 * | 1/2012 | Murakami et al. | 399/119 |
| 2012/0014722 | A1 | 1/2012 | Okino et al. | |
| 2013/0288173 | A1 | 10/2013 | Hashimoto et al. | |

FOREIGN PATENT DOCUMENTS

| | | | |
|---|---|---|---|
| EP | 1 361 481 | A1 | 11/2003 |
| EP | 2 416 223 | A1 | 2/2012 |
| JP | 2010-256894 | A | 11/2010 |
| WO | 2012/074034 | A1 | 6/2012 |

OTHER PUBLICATIONS

European Search Report dated Jan. 9, 2015 in European Application No. 14166297.3.

Kanno, et al., U.S. Appl. No. 14/261,140, filed Apr. 24, 2014.

Puri, "Characterizing Powder Flowability. Using mathematical models and measurement methods", www.chemicalprocessing.com, Jan. 2002, pp. 39-42.

* cited by examiner

*Primary Examiner* — Clayton E LaBalle
*Assistant Examiner* — Jas Sanghera
(74) *Attorney, Agent, or Firm* — Fitzpatrick, Cella, Harper and Scinto

(57) ABSTRACT

Provided is a developer replenishing cartridge excellent in accuracy with which an image forming apparatus is replenished with a developer irrespective of a use environment even when the developer is in a consolidated state. The developer replenishing cartridge includes: a developer replenishing container and a developer, being removably mountable to a developer replenishing apparatus; in which: the developer replenishing container includes a pump portion that operates so that a state where the internal pressure of a developer containing portion is lower than the atmospheric pressure and a state where the pressure is higher than the atmospheric pressure alternately repeatedly switch with each other; and the developer contains toner having a uniaxial collapse stress at a maximum consolidation stress of 10.0 kPa, of 2.5 kPa or more and 3.5 kPa or less.

12 Claims, 10 Drawing Sheets

DEVELOPER REPLENISHING CARTRIDGE AND DEVELOPER REPLENISHING METHOD

BACKGROUND OF THE INVENTION

1. Field of the Invention

The present invention relates to a developer replenishing cartridge, which is removably mountable to a developer replenishing apparatus and can be used in an image forming apparatus such as a copying machine, a facsimile, a printer, or a multifunction machine having two or more of functions of these apparatus, and a developer replenishing method.

2. Description of the Related Art

Hitherto, a particulate developer has been used in an electrophotographic image forming apparatus such as a copying machine, and the apparatus is configured to print an image while compensating for consumption of a developer in association with formation of the image through replenishment from a developer replenishing cartridge.

A developer replenishing container to be used in such related-art developer replenishing cartridge is, for example, a container described in Japanese Patent Application Laid-Open No. 2010-256894.

An apparatus described in Japanese Patent Application Laid-Open No. 2010-256894 adopts a system involving discharging a developer with a bellows pump provided in the developer replenishing container. A specific method is as described below. The bellows pump is expanded to bring an air pressure in the developer replenishing container into a state where the pressure is lower than the atmospheric pressure, whereby air is taken in the developer replenishing container to fluidize the developer. Further, the bellows pump is contracted to bring the air pressure in the developer replenishing container into a state where the pressure is higher than the atmospheric pressure, whereby the developer is extruded and discharged by a pressure difference between the inside and outside of the developer replenishing container. The apparatus is configured to discharge the developer stably by alternately repeating the two steps. However, there is a risk that the developer is tapped in the developer replenishing container to be excessively brought into a consolidated state by, for example, the vibration at the time of its transportation or storage state of the container. When the excessive consolidated state is established, a phenomenon called flushing in which a large amount of the developer is discharged all at once may occur in such system involving performing discharge control based on an internal pressure fluctuation as described above. In addition, the flowability of the developer fluctuates depending on a temperature and humidity of its storage environment. Accordingly, in order that the developer may be stably discharged with high replenishment accuracy even when exposed to an environmental fluctuation, matching property not only with the developer replenishing container but also with the developer needs to be improved.

SUMMARY OF THE INVENTION

An object of the present invention is to solve the problems. That is, the object is to provide a developer replenishing cartridge and a developer replenishing method each having additionally high accuracy with which an image forming apparatus is replenished with a developer in any storage environment or use environment.

The present invention relates to a developer replenishing cartridge, including: a developer replenishing container, and a developer, the developer replenishing cartridge being removably mountable to a developer replenishing apparatus; in which: the developer replenishing container includes (i) a developer containing portion for containing the developer, (ii) a discharge port for discharging the developer contained in the developer containing portion, and (iii) a pump portion that operates so that a state where an internal pressure of the developer containing portion is lower than an atmospheric pressure and a state where the internal pressure is higher than the atmospheric pressure alternately repeatedly switch with each other; the developer contains toner; the toner includes toner particles each containing a binder resin and a wax, and silica fine particles present on surfaces of the toner particles; the silica fine particles have a number-average particle diameter of primary particles of 60 nm or more and 300 nm or less; a coverage rate of the surfaces of the toner particles with the silica fine particles is 15% or more and 95% or less; the toner has a uniaxial collapse stress at a maximum consolidation stress of 10.0 kPa, of 2.5 kPa or more and 3.5 kPa or less; and the developer is contained in the developer containing portion of the developer replenishing container, and to a developer replenishing method.

According to the developer replenishing cartridge and developer replenishing method of the present invention, a developer can be discharged from a developer replenishing container with high accuracy in any storage state, and even when printing is performed on many sheets at a high print percentage, an image density fluctuation is suppressed.

Further features of the present invention will become apparent from the following description of exemplary embodiments with reference to the attached drawings.

DESCRIPTION OF THE EMBODIMENTS

Figure 1:
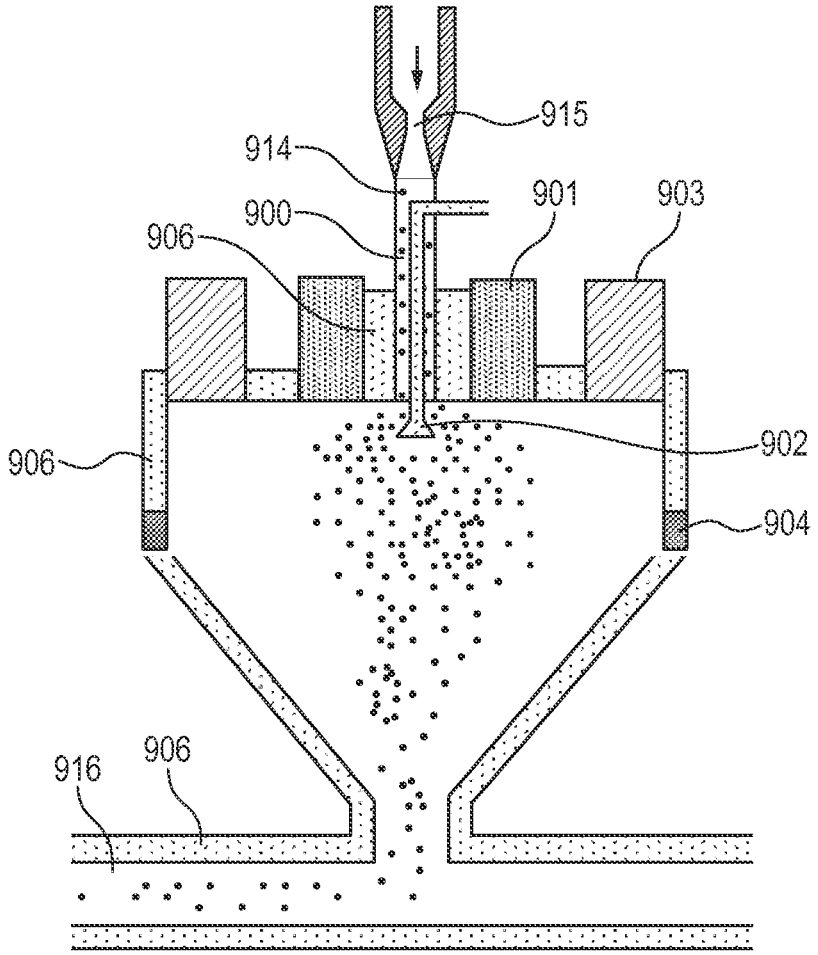
FIG. 1 is a view of a heat spheroidizing treatment apparatus to be used in the present invention.

Now, an embodiment for carrying out the present invention is described in detail.

According to one embodiment of the present invention, there is provided a developer replenishing cartridge, including: a developer replenishing container, and a developer, the developer replenishing cartridge being removably mountable to a developer replenishing apparatus; in which: the developer replenishing container includes (i) a developer containing portion for containing the developer, (ii) a discharge port for discharging the developer contained in the developer containing portion, and (iii) a pump portion that operates so that a state where an internal pressure of the developer containing portion is lower than an atmospheric pressure and a state where the internal pressure is higher than the atmospheric pressure alternately repeatedly switch with each other; the developer contains toner; the toner includes toner particles each containing a binder resin and a wax, and silica fine particles present on surfaces of the toner particles; the silica fine particles have a number-average particle diameter of primary particles of 60 nm or more and 300 nm or less; a coverage rate of the surface of the toner particles with the silica fine particles is 15% or more and 95% or less; the toner has a uniaxial collapse stress at a maximum consolidation stress of 10.0 kPa, of 2.5 kPa or more and 3.5 kPa or less; and the developer is contained in the developer containing portion of the developer replenishing container.

As a result of their extensive studies, the inventors of the present invention have found that in the developer replenishing container that performs dischargeability control through a change in internal pressure of the developer containing portion, it is important to cover the surface of the toner with the silica fine particles at a ratio in a specific range and to control the uniaxial collapse stress of the toner in a consolidated state to a specific value. The inventors have found that with such configuration, a good discharge characteristic of the developer is obtained even when the developer passes an excessive consolidated state upon, for example, transportation of the developer replenishing container.

Although a mechanism for the foregoing is unknown, the inventors of the present invention consider the mechanism to be as described below.

When the developer is in a consolidated state in the developer replenishing container, a large amount of the developer is present even in the discharge portion of the container. When intake and exhaust are performed in the state in the developer replenishing container, the developer is loosened and discharged in a state of being reduced in bulk density.

At that time, the developer to be used in the present invention is moderately dispersed because an adhesive force between toners in the consolidated state is controlled. Accordingly, the occurrence of a discharge failure such as a flushing phenomenon caused by the discharge of an excessively bulky developer due to excessive loosening or a reduction in discharge amount caused by an insufficient degree of loosening is suppressed.

In addition, in the developer to be used in the present invention, an adhesive force between the developer replenishing container member and the toner can be weakened by controlling the coverage rate of the surfaces of the toner particles with the silica fine particles within the range. Probably as a result of the foregoing, the adhesion of the developer to the inner wall of the developer replenishing container is suppressed even when the developer passes the consolidated state, and hence the amount of remaining toner in a developer cartridge used-up state can be reduced.

In the present invention, the toner contains toner particles each having a binder resin and a wax, and silica fine particles present on the surfaces of the toner particles.

In addition, the silica fine particles present on the surfaces of the toner particles have a number-average particle diameter of primary particles of 60 nm or more and 300 nm or less, and the coverage rate of the surfaces of the toner particles with the silica fine particles is 15% or more and 95% or less (preferably 20% or more and 95% or less).

When the number-average particle diameter of primary particles of the silica fine particles is less than 60 nm, the following tendency is observed: irregularities in the surface of the toner are suppressed, adhesion property between the toner and the member rises, and the amount of the developer remaining in the developer replenishing container increases. In addition, when the number-average particle diameter exceeds 300 nm, the dispersion of the silica fine particles in the surface of the toner is liable to be nonuniform and hence the coverage rate cannot be satisfied. In addition, a variation in adhesive force between the toners occurs and hence the discharge amount is liable to be unstable.

In addition, when the coverage rate with the silica fine particles is less than 15% (preferably less than 20%), the following tendency is observed: the adhesive force between the developer and the inner wall of the container increases, and the amount of the remaining developer similarly increases.

In addition, one feature of the present invention is that the uniaxial collapse stress of the toner at the time of a maximum consolidation stress of 10.0 kPa is 2.5 kPa or more and 3.5 kPa or less. When the uniaxial collapse stress is less than 2.5 kPa, the adhesive force between the toners reduces, a toner lump collapses in a consolidated state at the time of transfer, and the flushing phenomenon at the time of discharge is liable to occur. In addition, when the uniaxial collapse stress exceeds 3.5 kPa, a loosening effect on the developer exhibited by the intake and exhaust motion of the developer replenishing container becomes insufficient, and hence the discharge is liable to be unstable owing to, for example, discharge clogging.

In addition, in the present invention, the toner preferably has a sticking ratio of the silica fine particles of 80 mass % or more with reference to the total amount of the silica fine particles. When the ratio is 80 mass % or more, stable dischargeability of the toner can be satisfactorily maintained even in long-term use.

In order that the uniaxial collapse stress of the toner at the time of consolidation may be set to fall within the range specified in the present invention while the coverage rate with the silica fine particles is set to be relatively large like the present invention, such a method as described below can be given: for example, a polymer having a structure in which a vinyl-based resin component and a hydrocarbon compound react with each other is incorporated into each toner particle, and the silica fine particles are stuck to the surfaces of the toner particles by hot air treatment.

The incorporation of the polymer into the toner can improve the dispersibility of the wax in the toner, and can increase the speed at which the wax moves to the surface of each toner particle at the time of the hot air treatment. When the silica fine particles are stuck by the hot air treatment in the toner containing the polymer as described above, the wax is unevenly distributed between each of the silica fine particles stuck to the surfaces of the toner particles and the polymer, and hence toner having such a feature as described above is obtained.

In addition, the developer is more preferably a two-component developer containing the toner and a carrier. In addition, the content of the toner is preferably 3.0 parts by mass or more and 30.0 parts by mass or less with respect to 1.0 part by mass of the carrier.

The incorporation of the carrier having a specific gravity different from that of the toner into the developer improves a stirring effect on the developer, and easily expresses effects on its dischargeability and adhesion resistance.

A conventionally known carrier can be used as the carrier. For example, a carrier obtained by covering the surface of a ferrite core particle with a resin, a magnetic material-dispersed resin carrier obtained by dispersing a magnetic material particle in a resin, or a carrier obtained by filling the voids of a porous core particle with a resin can be used. Now, each component to be incorporated into the toner is described.

[Binder Resin]

The binder resin to be used in the toner of the present invention is not particularly limited, and any one of the following polymers and resins can be used.

There may be used, for example: homopolymers of styrene and substituted styrenes such as polystyrene, poly-p-chlorostyrene, and polyvinyltoluene; styrene-based copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-α-methyl chloromethacrylate copolymer, a styrene-acrylonitrile copolymer, a styrene-vinyl methyl ether copolymer, a styrene-vinyl ethyl ether copolymer, a styrene-vinyl methyl ketone copolymer, and a styrene-acrylonitrile-indene copolymer; and polyvinyl chloride, a phenol resin, a natural resin-modified phenol resin, a natural resin-modified maleic acid resin, an acrylic resin, a methacrylic resin, polyvinyl acetate, a silicone resin, a polyester resin, polyurethane, a polyamide resin, a furan resin, an epoxy resin, a xylene resin, polyvinyl butyral, a terpene resin, a coumarone-indene resin, and a petroleum-based resin.

Of those, a polyester resin is preferably used from the viewpoints of low-temperature fixability and chargeability control.

The polyester resin to be preferably used in the present invention is a resin having a "polyester unit" in its binder resin chain. As a component constituting the polyester unit, there are specifically given, for example: a di- or higher hydroxylic alcohol monomer component; and acid monomer components such as a di- or higher carboxylic acid, a di- or higher carboxylic anhydride, and a di- or higher carboxylic acid ester.

Examples of the di- or higher hydroxylic alcohol monomer component include alkyleneoxide adducts of bisphenol A such as polyoxypropylene(2.2)-2,2-bis(4-hydroxyphenyl) propane, polyoxypropylene(3.3)-2,2-bis(4-hydroxyphenyl) propane, polyoxyethylene(2.0)-2,2-bis(4-hydroxyphenyl) propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylolethane, trimethylolpropane, and 1,3,5-trihydroxymethylbenzene.

Of those, an aromatic diol is preferably used as the alcohol monomer component. In the alcohol monomer component constituting the polyester resin, the aromatic diol is preferably contained at a ratio of 80 mol % or more.

On the other hand, examples of the acid monomer components such as the di- or higher carboxylic acid, the di- or higher carboxylic anhydride, and the di- or higher carboxylic acid ester include: aromatic dicarboxylic acids such as phthalic acid, isophthalic acid, and terephthalic acid or anhydrides thereof; alkyl dicarboxylic acids such as succinic acid, adipic acid, sebacic acid, and azelaic acid or anhydrides thereof; succinic acid substituted with an alkyl group or alkenyl group having 6 to 18 carbon atoms or an anhydride thereof; and unsaturated dicarboxylic acids such as fumaric acid, maleic acid, and citraconic acid or anhydrides thereof.

Of those, a polyhydric carboxylic acid such as terephthalic acid, succinic acid, adipic acid, fumaric acid, trimellitic acid, pyromellitic acid, benzophenonetetracarboxylic acid, or an anhydride thereof is preferably used as the acid monomer component.

In addition, the acid value of the polyester resin is preferably 1 mgKOH/g or more and 20 mgKOH/g or less because the triboelectric charge quantity of the toner is more likely to stabilize.

It should be noted that the acid value can be set to fall within the range by adjusting the kind and blending amount of the monomer to be used in the resin. Specifically, the acid value can be controlled by adjusting an alcohol monomer component ratio or acid monomer component ratio at the time of the production of the resin, and the molecular weight. In addition, the acid value can be controlled by causing a terminal alcohol to react with a polyacid monomer (such as trimellitic acid) after ester condensation polymerization.

The toner of the present invention preferably contains, in a toner particle thereof, a polymer having a structure in which a vinyl-based resin component and a hydrocarbon compound react with each other.

The polymer having the structure in which the vinyl-based resin component and the hydrocarbon compound react with each other is particularly preferably a graft polymer having a structure in which a polyolefin is grafted to the vinyl-based resin component or a graft polymer having the vinyl-based resin component in which a vinyl-based monomer is subjected to graft polymerization with the polyolefin.

The polymer having the structure in which the vinyl-based resin component and the hydrocarbon compound react with each other serves like a surfactant on the binder resin and wax that have melted in a kneading step or surface-smoothening step at the time of the production of the toner. Therefore, the polymer is preferred because the primary average dispersion particle diameter of the wax in the toner particles can be controlled, and the speed at which the wax migrates to the surface of the toner at the time of surface treatment to be performed as required with hot air can be controlled.

With regard to the graft polymer containing the structure in which the polyolefin is grafted to the vinyl-based resin component or the graft polymer containing the vinyl-based resin component in which the vinyl-based monomer is subjected to graft polymerization with the polyolefin, the polyolefin is not particularly limited as long as the polyolefin is a polymer or copolymer of an unsaturated hydrocarbon-based monomer having one double bond, and various polyolefins can each be used. Of those, polyethylenes and polypropylenes are each particularly preferably used.

Meanwhile, examples of the vinyl-based monomer include the following monomers.

Styrene-based monomers such as styrene and derivatives thereof, such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene.

Nitrogen atom-containing vinyl-based monomers such as: an amino group-containing α-methylene aliphatic monocarboxylic acid ester such as dimethylaminoethyl methacrylate or diethylaminoethyl methacrylate; and an acrylic acid or methacrylic acid derivative, e.g., acrylonitrile, methacrylonitrile, or acrylamide.

Carboxyl group-containing vinyl-based monomers such as: unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and an alkenylsuccinic anhydride; unsaturated dibasic acid half esters such as methyl maleate half ester, ethyl maleate half ester, butyl maleate half ester, methyl citraconate half ester, ethyl citraconate half ester, butyl citraconate half ester, methyl itaconate half ester, a methyl alkenylsuccinate half ester, methyl fumarate half ester, and methyl mesaconate half ester; unsaturated dibasic acid esters such as dimethyl maleate and dimethyl fumarate; α,β-unsaturated acids such as acrylic acid, methacrylic acid, crotonic acid, and cinnamic acid; α,β-unsaturated acid anhydrides such as crotonic anhydride and cinnamic anhydride, and anhydrides of the α,β-unsaturated acids and lower fatty acids; and monomers each having a carboxyl group such as an alkenylmalonic acid, an alkenylglutaric acid, and an alkenyladipic acid, and acid anhydrides thereof, and monoesters thereof.

Hydroxyl group-containing vinyl-based monomers such as: acrylic acid esters and mathacrylic acid esters such as 2-hydroxyethyl acrylate, 2-hydroxyethyl methacrylate, and 2-hydroxypropyl methacrylate; and 4-(1-hydroxy-1-methylbutyl)styrene and 4-(1-hydroxy-1-methylhexyl)styrene.

Ester units formed of acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate.

Ester units formed of methacrylates including α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate.

The polymer having the structure in which the vinyl-based resin component and the hydrocarbon compound react with each other can be obtained by a known method such as a reaction between monomers for these polymers described in the foregoing, or a reaction between a monomer for one of the polymers and the other polymer.

A styrene-based unit and acrylonitrile or methacrylonitrile are preferably incorporated as constituent units for the vinyl-based resin component.

A mass ratio (hydrocarbon compound/vinyl-based resin component) between the hydrocarbon compound and vinyl-based resin component in the polymer is preferably 1/99 to 75/25. The hydrocarbon compound and the vinyl-based resin component are preferably used at a ratio in the range because the wax can be satisfactorily dispersed in each of the toner particles, and the speed at which the wax migrates to the surface of the toner at the time of the surface treatment to be performed as required with hot air can be controlled.

The content of the polymer having the structure in which the vinyl-based resin component and the hydrocarbon compound react with each other is preferably 0.2 part by mass or more and 20 parts by mass or less with respect to 100 parts by mass of the binder resin.

The polymer is preferably used at a content in the range because the wax can be satisfactorily dispersed in each of the toner particles, and the speed at which the wax migrates to the surface of the toner at the time of the surface treatment to be performed with hot air can be controlled.

[Wax]

The wax to be used in the toner of the present invention is not particularly limited. Examples thereof include: a hydrocarbon-based wax such as low-molecular-weight polyethylene, low-molecular-weight polypropylene, an alkylene copolymer, microcrystalline wax, paraffin wax, or Fischer-Tropsch wax; an oxide of a hydrocarbon-based wax such as oxidized polyethylene wax or a block copolymerization product thereof; a wax containing a fatty acid ester as a main component, such as carnauba wax; and a wax obtained by subjecting part or all of a fatty acid ester to deoxidization such as deoxidized carnauba wax. Further examples thereof include: a saturated linear fatty acid such as palmitic acid, stearic acid, or montanic acid; a unsaturated fatty acid such as brassidic acid, eleostearic acid, or parinaric acid; a saturated alcohol such as stearyl alcohol, aralkyl alcohol, behenyl alcohol, carnaubyl alcohol, ceryl alcohol, or melissyl alcohol; a polyhydroxylic alcohol such as sorbitol; an ester formed of a fatty acid such as palmitic acid, stearic acid, behenic acid, or montanic acid, and an alcohol such as stearyl alcohol, aralkyl alcohol, behenyl alcohol, carnaubyl alcohol, ceryl alcohol, or melissyl alcohol; a fatty acid amide such as linoleamide, oleamide, or lauramide; a saturated fatty acid bisamide such as methylenebisstearamide, ethylenebiscaprylamide, ethylenebislauramide, or hexamethylenebisstearamide; an unsaturated fatty acid amide such as ethylenebisoleamide, hexamethylenebisoleamide, N,N'-dioleyladipamide, or N,N'-dioleylsebacamide; an aromatic bisamide such as m-xylenebisstearamide or N,N'-distearylisophthalamide; an aliphatic metal salt such as calcium stearate, calcium laurate, zinc stearate, or magnesium stearate (generally referred to as metal soap); wax obtained by grafting aliphatic hydrocarbon-based wax with a vinyl-based monomer such as styrene or acrylic acid; a partially esterified product formed of a fatty acid such as behenic acid monoglyceride and a polyhydroxylic alcohol; and a methyl ester compound having a hydroxyl group obtained by subjecting a vegetable oil and fat to hydrogenation.

Of those waxes, a hydrocarbon-based wax such as paraffin wax or Fischer-Tropsch wax is preferred from the viewpoint of improving the low-temperature fixability and fixation winding resistance.

The wax is preferably used at a content of 0.5 part by mass or more and 20 parts by mass or less with respect to 100 parts by mass of the binder resin. In addition, the peak temperature of the highest endothermic peak present in the temperature range of from 30° C. or more to 200° C. or less in an endothermic curve at the time of temperature increase to be measured with a differential scanning calorimeter (DSC) is preferably 50° C. or more and 110° C. or less from the viewpoint of compatibility between the storage stability and hot offset resistance of the toner.

[Coloring Agent]

As a coloring agent that can be incorporated into the toner of the present invention, there are given the following coloring agents.

As a black coloring agent, there are given: carbon black; and a coloring agent toned to a black color with a yellow coloring agent, a magenta coloring agent, and a cyan coloring agent. Although a pigment may be used alone as the coloring agent, a dye and the pigment are more preferably used in combination to improve the clarity of the coloring agent in terms of the quality of a full-color image.

As a magenta coloring pigment, there are given, for example: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, or 282; C.I. Pigment Violet 19; and C.I. Vat Red 1, 2, 10, 13, 15, 23, 29, or 35.

As a magenta coloring dye, there are given, for example: oil-soluble dyes such as: C.I. Solvent Red 1, 3, 8, 23, 24, 25, 27, 30, 49, 81, 82, 83, 84, 100, 109, or 121; C.I. Disperse Red 9; C.I. Solvent Violet 8, 13, 14, 21, or 27; and C.I. Disperse Violet 1; and basic dyes such as: C.I. Basic Red 1, 2, 9, 12, 13, 14, 15, 17, 18, 22, 23, 24, 27, 29, 32, 34, 35, 36, 37, 38, 39, or 40; and C.I. Basic Violet 1, 3, 7, 10, 14, 15, 21, 25, 26, 27, or 28.

As a cyan coloring pigment, there are given, for example: C.I. Pigment Blue 2, 3, 15:2, 15:3, 15:4, 16, or 17; C.I. Vat Blue 6; C.I. Acid Blue 45; and a copper phthalocyanine pigment in which a phthalocyanine skeleton is substituted by 1 to 5 phthalimidomethyl groups.

For example, C.I. Solvent Blue 70 is given as a cyan coloring dye.

As a yellow coloring pigment, there are given, for example: C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, or 185; and C.I. Vat Yellow 1, 3, or 20.

For example, C.I. Solvent Yellow 162 is given as a yellow coloring dye.

The coloring agent is preferably used in an amount of 0.1 part by mass or more and 30 parts by mass or less with respect to 100 parts by mass of the binder resin.

[Charge Control Agent]

The toner of the present invention may contain a charge control agent as required. As the charge control agent to be incorporated into the toner, a known agent may be adopted. In particular, a metal compound of an aromatic carboxylic acid, which is colorless, provides a high charging speed of the toner, and can stably maintain a constant charge amount, is preferred.

As a negative charge control agent, there are given a metal salicylate compound, a metal naphthoate compound, a metal dicarboxylate compound, a polymeric compound having a sulfonic acid or a carboxylic acid in a side chain, a polymeric compound having a sulfonic acid salt or a sulfonic acid aster in a side chain, a polymeric compound having a carboxylic acid salt or a carboxylic acid ester in a side chain, a boron compound, a urea compound, a silicon compound, and a calixarene. The charge control agent may be internally added to each of the toner particles, or may be externally added thereto. The addition amount of the charge control agent is preferably 0.2 part by mass or more and 10 parts by mass or less with respect to 100 parts by mass of the binder resin.

[Silica Fine Particles]

Silica fine particles produced by an arbitrary method such as a wet method, a flame-melting method, or a vapor phase method are preferably used as the silica fine particles of the present invention.

The wet method is, for example, a sol-gel method involving: dropping an alkoxysilane in an organic solvent in which water is present; subjecting the mixture to hydrolysis and a condensation reaction with a catalyst; removing the solvent from the resultant silica sol suspension; and drying the residue to provide a sol-gel silica.

The flame-melting method is, for example, a method involving: gasifying a silicon compound that is gaseous or liquid at normal temperature in advance; and then decomposing and melting the silicon compound in an outer flame, which is formed by supplying a combustible gas formed of hydrogen and/or a hydrocarbon, and oxygen, to provide the silica fine particles (molten silica). In the flame-melting method, the following can be performed: in the outer flame, simultaneously with the production of the silica fine particles from the silicon compound, the silica fine particles are caused to fuse and coalesce with each other so that the particles may have desired particle diameters and shapes, and then the resultant is cooled and collected with a bag filter or the like. The silicon compound to be used as a raw material is not particularly limited as long as the compound is gaseous or liquid at normal temperature. Examples thereof include: a cyclic siloxane such as hexamethylcyclotrisiloxane, octamethylcyclotetrasiloxane, or decamethylcyclopentasiloxane; a siloxane such as hexamethyldisiloxane or octamethyltrisiloxane; an alkoxysilane such as tetramethoxysilane, tetraethoxysilane, methyltrimethoxysilane, or dimethyldimethoxysilane; an organic silane compound such as tetramethylsilane, diethylsilane, or hexamethyldisilazane; a silicon halide such as monochlorosilane, dichlorosilane, trichlorosilane, or tetrachlorosilane; and an inorganic silicon compound such as monosilane or disilane.

The vapor phase method is, for example, a fumed method involving burning silicon tetrachloride together with a mixed gas of oxygen, hydrogen, and a diluent gas (such as nitrogen, argon, or carbon dioxide) at high temperature to produce the silica fine particles.

The silica fine particles are preferably subjected to surface treatment for the purpose of subjecting their surfaces to hydrophobizing treatment. A silane coupling agent or a silicone oil is preferably used as a surface treatment agent to be used at this time.

Examples of the silane coupling agent include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, a triorganosilylmercaptan, trimethylsilylmercaptan, a triorganosilyl acrylate, vinyldimethylacetoxysilane, dimethyldiethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to one silicon atom in a unit positioned at the end.

Examples of the silicone oil to be used in the treatment of the silica fine particles to be used in the present invention include a dimethyl silicone oil, an alkyl-modified silicone oil, an α-methylstyrene-modified silicone oil, a chlorophenyl silicone oil, and a fluorine-modified silicone oil. The silicone oil is not limited to those described above. The silicone oil preferably has a viscosity at a temperature of 25° C. of 50 to 1,000 $mm^2/s$. When the viscosity is less than 50 $mm^2/s$, the application of heat volatilizes part of the oil and hence the charging characteristic is liable to deteriorate. When the viscosity exceeds 1,000 $mm^2/s$, it becomes difficult to handle the oil in a treating operation. A known technology can be adopted as a method for a silicone oil treatment. Examples of the method include: a method involving mixing silicic acid fine powder and the silicone oil by using a mixer; a method involving spraying the silicone oil in the silicic acid fine powder by using an atomizer; and a method involving dissolving the silicone oil in a solvent and mixing the solution with the silicic acid fine powder. The treatment method is not limited thereto.

The silica fine particles of the present invention are particularly preferably treated with hexamethyldisilazane or the silicone oil as a surface treatment agent.

[External Additive]

In the present invention, an external additive may be further added as required for an improvement in flowability or the adjustment of the triboelectric charge quantity.

The external additive is preferably inorganic fine particles each made of, for example, silica, titanium oxide, aluminum oxide, or strontium titanate. The inorganic fine particles are preferably subjected to hydrophobizing treatment with a hydrophobizing agent such as a silane compound or a silicone oil, or a mixture thereof.

With regard to the specific surface area of the external additive to be used, inorganic fine particles having a specific surface area of 10 $m^2/g$ or more and 50 $m^2/g$ or less are preferred from the viewpoint of the suppression of the embedding of the external additive.

In addition, the external additive is preferably used in an amount of 0.1 part by mass or more and 5.0 parts by mass or less with respect to 100 parts by mass of the toner particles.

Although a known mixer such as a Henschel mixer can be used in the mixing of the toner particles and the external additive, the apparatus is not particularly limited as long as the particles and the additive can be mixed with the apparatus.

[Production Method]

A known production method can be adopted as a method of producing the toner of the present invention without any particular limitation. Now, description is given by taking a method of producing the toner involving adopting a pulverization method as an example.

In a raw material-mixing step, predetermined amounts of materials constituting the toner particles, e.g., the binder resin and the wax, and other components such as the coloring agent and the charge control agent to be used as required are weighed, and the materials are blended and mixed. As a mixing apparatus, there are given, for example, a double cone mixer, a V-shape mixer, a drum type mixer, a super mixer, a Henschel mixer, a Nauta mixer, and MECHANO HYBRID (NIPPON COKE & ENGINEERING CO., LTD.).

Next, the mixed materials are melt-kneaded to disperse the wax and the like in the resin. In the melt-kneading step, a batch kneader such as a pressurizing kneader or a Banbury mixer, or a continuous kneader can be used. A single-screw or a twin-screw extruder is a mainstream because of advantages of continuous production. Examples thereof include: a twin-screw extruder model KTK (manufactured by Kobe Steel., Ltd.); a twin-screw extruder model TEM (manufactured by Toshiba Machine CO., Ltd.); a PCM kneader (manufactured by Ikegai Corp.); a twin-screw extruder (manufactured by KCK CO., Ltd.); a co-kneader (manufactured by Buss Inc.); and KNEADEX (NIPPON COKE & ENGINEERING CO., LTD.). Further, a resin composition obtained by the melt-kneading may be rolled by a twin roll or the like, and cooled with water or the like in a cooling step.

Next, the cooled product of the resin composition is pulverized to a desired particle diameter in a pulverizing step. In the pulverizing step, the cooled product is coarsely pulverized with a pulverizer such as a crusher, a hammer mill, or a feather mill, and is then finely pulverized with, for example, a Kryptron System (manufactured by Kawasaki Heavy Industries, Ltd.), a Super Rotor (manufactured by Nisshin Engineering Inc.), a Turbo Mill (manufactured by Turbo Kogyo Co., Ltd.), or a fine pulverizer based on an air-jet system.

After that, as required, the resultant particles are classified with an inertial classification type classifier or siever such as Elbow-Jet (manufactured by NITTETSU MINING CO., LTD), or a centrifugal type classifier or siever such as Turboplex (manufactured by Hosokawa Micron Corporation), TSP Separator (manufactured by Hosokawa Micron Corporation), or Faculty (manufactured by Hosokawa Micron Corporation) to obtain toner particles.

In addition, after the pulverization, the surface treatment of the toner particles, such as spheroidizing treatment, may be performed with Hybridization System (manufactured by NARA MACHINERY CO., LTD.), Mechanofusion System (manufactured by Hosokawa Micron Corporation), Faculty (manufactured by Hosokawa Micron Corporation), or Meteorainbow MR Type (manufactured by Nippon Pneumatic Mfg. Co., Ltd.) as required.

In the present invention, the following is particularly preferably performed: the silica fine particles are dispersed in the surfaces of the toner particles obtained by the production method, and the silica fine particles are stuck to the surfaces of the toner particles by surface treatment with hot air in the dispersed state.

In the present invention, the toner can be obtained by performing surface treatment with hot air by using, for example, a surface treatment apparatus illustrated in FIG. 1 and performing classification as required.

The surface treatment with hot air is particularly preferably as follows: the toner is ejected by injection from a high-pressure air supply nozzle, the surface of the ejected toner is treated by exposing the toner to hot air, and the temperature of the hot air falls within the range of from 100° C. or more to 450° C. or less.

Now, the outline of a method for the surface treatment involving using hot air is described with reference to FIG. 1, but the method is not limited thereto. FIG. 1 is a sectional view illustrating an example of the surface treatment apparatus used in the present invention. Specifically, the inorganic fine particles are dispersed in the surfaces of the toner particles and then the resultant particles are supplied to the surface treatment apparatus. Then, toner particles 914 supplied from a toner supply port 900 are accelerated by injection air injected from a high-pressure air supply nozzle 915 and travel to an airflow injecting member 902 below the nozzle. Diffusion air is injected from the airflow injecting member 902 and the toner particles are diffused to an outer direction by the diffusion air. At this time, the diffused state of the toner can be controlled by regulating the flow rate of the injection air and the flow rate of the diffusion air.

In addition, the outer periphery of the toner supply port 900, the outer periphery of the surface treatment apparatus, and the outer periphery of a transfer piping 916 are each provided with a cooling jacket 906 for the purpose of preventing the fusion of the toner particles. It should be noted that cooling water (preferably antifreeze such as ethylene glycol) is preferably passed through the cooling jacket. Meanwhile, the surfaces of the toner particles diffused by the diffusion air are treated with hot air supplied from a hot air supply port 901. At this time, a temperature C (° C.) of the hot air is preferably 100° C. or more and 450° C. or less, more preferably 100° C. or more and 400° C. or less, particularly preferably 150° C. or more and 300° C. or less.

When the temperature of the hot air is less than 100° C., a variation in surface roughness may occur in the surfaces of the toner particles. In addition, when the temperature exceeds 450° C., the molten state progresses to so large an extent that the coalescence of the toners may progress to cause the coarsening and fusion of the toner.

The toner particles whose surfaces have been treated with the hot air are cooled with cold air supplied from a cold air supply port 903 provided on the outer periphery of the upper portion of the apparatus. At this time, cold air may be introduced from a second cold air supply port 904 provided on a side surface of the main body of the apparatus for the purposes of controlling a temperature distribution in the apparatus and controlling the surface state of the toner. A slit shape, a louver shape, a porous plate shape, a mesh shape, or the like can be used in the outlet of the second cold air supply port 904, and a direction horizontal to a central direction or a direction along the wall surface of the apparatus can be selected as the direction in which the cold air is introduced depending on purposes. At this time, a temperature E (° C.) of the cold air is preferably −50° C. or more and 10° C. or less, more preferably −40° C. or more and 8° C. or less. In addition, the cold air is preferably dehumidified cold air. Specifically, the absolute moisture content of the cold air is preferably 5 $g/m^3$ or less, more preferably 3 $g/m^3$ or less.

When the temperature of the cold air is less than −50° C., a temperature in the apparatus reduces to so large an extent that the treatment with heat as an original object is not sufficiently performed and hence the spheroidization of the toner particles cannot be performed in some cases. In addition, when the temperature exceeds 10° C., the control of a hot air zone in the apparatus becomes insufficient, the coalescence of the particles progresses, and the coarsening of powder particles occurs in some cases. In addition, when the absolute moisture content of the cold air exceeds 5 $g/m^3$, the hydrophilicity of the cold air rises. As a result, the elution rate of the wax slows down. Accordingly, the following tendency is observed: it becomes hard to control the sticking ratio of the silica fine particles within the range of the present application.

After that, the cooled toner particles are sucked with a blower and recovered with a cyclone or the like through the transfer piping 916.

In addition, surface modification and spheroidizing treatment may be further performed with a Hybridization System manufactured by NARA MACHINERY CO., LTD. or a Mechanofusion System manufactured by Hosokawa Micron Corporation as required. In such case, a sieving machine such as an air sieve HIBOLTER (manufactured by SHINTOKYO KIKAI CO., LTD.) may be used as required.

After that, other inorganic fine particles may be externally added as required for imparting flowability and improving charge stability. Examples of the mixing apparatus include a double cone mixer, a V-type mixer, a drum-type mixer, a supermixer, a Henschel mixer, a Nauta mixer, or MECHANO HYBRID (manufactured by NIPPON COKE & ENGINEERING CO, LTD.).

Next, methods of measuring respective physical properties related to the present invention are described.

[Methods of Measuring Maximum Consolidation Stress (a) and Uniaxial Collapse Stress (b)]

A maximum consolidation stress (a) and a uniaxial collapse stress (b) are measured with a Shear Scan TS-12 (manufactured by Sci-Tec), and the Shear Scan performs the measurement according to a principle based on a Mohr-Coulomb model described in "CHARACTERIZING POWDER FLOWABILITY (published on Jan. 24, 2002)" written by Prof. Virendra M. Puri.

Specifically, the measurement was performed with a linear shear cell (columnar, diameter: 80 mm, volume: 140 $cm^3$), to which a shearing force could be linearly applied in a sectional direction, in a room temperature environment (23° C., 60% RH). The toner is loaded into the cell and a vertical load is applied so as to be 1.0 kPa, whereby a consolidated powder layer is produced so as to be in the closest packing state at the vertical load (the measurement with the Shear Scan is preferred in the present invention because a pressure in the consolidated state can be detected automatically and produced without any individual difference). Consolidated powder layers are similarly formed by setting the vertical load to 3.0 kPa, 5.0 kPa, and 7.0 kPa. Then, a shearing force is gradually applied to the sample formed at each vertical load while the vertical load applied upon formation of the consolidated powder layer is continuously applied, and a test for measuring the fluctuation of a shearing stress at that time is performed to decide a stationary point. Whether the consolidated powder layer has reached the stationary point is judged as follows: when the displacement of the shearing stress and the displacement in a vertical direction of a load applying unit for applying the vertical load reduce, and both the displacements start to take stable values in the test, the layer is judged to have reached the stationary point. Next, the vertical load is gradually released from the consolidated powder layer that has reached the stationary point, a failure envelope at each load (vertical load stress versus shearing stress plot) is created, and a Y intercept and a slope are determined. In analysis based on the Mohr-Coulomb model, the uniaxial collapse stress and the maximum consolidation stress are represented by the following equations, and the Y intercept and the slope represent a "cohesive force" and an "internal friction angle," respectively.

$$\text{Uniaxial collapse stress}(b)=2c(1+\sin\phi)/\cos\phi$$

$$\text{Maximum consolidation stress}(a)=((A-(A^2\sin^2\phi-\tau_{ssp}{}^2\cos^2\phi)^{0.5})/\cos^2\phi\times(1+\sin\phi)-(c/\tan\phi)$$

($A=\sigma_{ssp}+(c/\tan\phi)$, $c$=cohesive force, $\phi$=internal friction angle, $T_{ssp}=c+\sigma_{ssp}\times\tan\phi$, $\sigma_{ssp}$=vertical load at the stationary point)

The uniaxial collapse stress and maximum consolidation stress calculated at each load are plotted (flow function plot), and a straight line is drawn based on the plot. A uniaxial collapse stress at the time of a maximum consolidation stress of 10.0 kPa is determined from the straight line.

In the present invention, it is important to control the uniaxial collapse stress of the toner at the time of a maximum consolidation stress of 10.0 kPa to 2.5 kPa or more and 3.5 kPa or less.

[Calculation of Coverage Rate X]

A coverage rate X of surfaces of the toner particles with silica fine particles in the present invention is calculated by analyzing a toner surface image, which is photographed with a Hitachi ultra-high resolution field-emission scanning electron microscope S-4800 (Hitachi High-Technologies Corporation), with image analysis software Image-Pro Plus ver. 5.0 (NIPPON ROPER K.K.). Conditions under which the image is photographed with the S-4800 are as described below.

(1) Sample Production

A conductive paste is applied in a thin manner to a sample stage (aluminum sample stage measuring 15 mm by 6 mm) and the paste is sprayed with the toner. Further, air blowing is performed to remove excess toner from the sample stage and to dry the remaining toner sufficiently. The sample stage is set in a sample holder and the height of the sample stage is regulated to 36 mm with a sample height gauge.

(2) Setting of Conditions for Observation with S-4800

The calculation of the coverage rate X is performed with an image obtained by reflected electron image observation with the S-4800. A reflected electron image is reduced in charge-up of the inorganic fine particles as compared to a secondary electron image, and hence the coverage rate X can be measured with high accuracy. It should be noted that when particles except the silica fine particles are present on the surfaces of the toner particles, elemental analysis is performed with an energy-dispersive X-ray analyzer (EDAX) to identify the silica fine particles, followed by the calculation of the coverage rate X.

Liquid nitrogen is poured into an anti-contamination trap attached to the mirror body of the S-4800 until the liquid overflows, and the trap is left for 30 minutes. The "PC-SEM" of the S-4800 is activated to perform flushing (the cleaning of an FE chip as an electron source). The acceleration voltage display portion of a control panel on a screen is clicked and a [Flushing] button is pressed to open a flushing execution dialog. After it has been confirmed that a flushing intensity is 2, the flushing is executed. It is confirmed that an emission current by the flushing is 20 to 40 μA. The sample holder is inserted into the sample chamber of the mirror body of the S-4800. [Origin] on the control panel is pressed to move the sample holder to an observation position.

The acceleration voltage display portion is clicked to open an HV setting dialog, and an acceleration voltage and the emission current are set to [0.8 kV] and [20 μA], respectively. In the [Basic] tab of an operation panel, [SE] is selected in signal selection, and [Upper (U)] and [+BSE] are selected for an SE detector. In the right selection box of [+BSE], [L.A. 100] is selected to set a mode in which observation is performed with a reflected electron image. Similarly, in the [Basic] tab of the operation panel, the probe current, focus mode, and WD of an electronic optical system condition block are set to [Normal], [UHR], and [3.0 mm], respectively. The [ON] button of the acceleration voltage display portion of the control panel is pressed to apply the acceleration voltage.

(3) Focus Adjustment

The focus knob [COARSE] of the operation panel is rotated, and after some degree of focusing has been achieved, aperture alignment is adjusted. The [Align] of the control panel is clicked to display an alignment dialog and [Beam] is selected. The STIGMA/ALIGNMENT knob (X, Y) of the operation panel is rotated to move a beam to be displayed to the center of a concentric circle. Next, [Aperture] is selected and the STIGMA/ALIGNMENT knob (X, Y) is rotated by one to perform focusing so that the movement of an image may be stopped or minimized. The aperture dialog is closed and focusing is performed by autofocusing. After that, a magnification is set to 50,000 (50 k), focus adjustment is performed with the focus knob and the STIGMA/ALIGNMENT knob in the same manner as in the foregoing, and focusing is performed again by autofocusing. Focusing is performed by repeating the foregoing operations again. When the tilt angle of a surface to be observed is large, the accuracy with which the coverage rate is measured is liable to reduce. Accordingly, a toner particle whose surface has as small a tilt as possible is selected and analyzed by selecting such a toner particle that the entire surface to be observed is simultaneously in focus upon focus adjustment.

(4) Image Storage

Brightness adjustment is performed according to an ABC mode, and a photograph is taken at a size of 640×480 pixels and stored. The following analysis is performed with the image file. One photograph is taken for one toner particle and images are obtained for at least 30 toner particles.

(5) Image Analysis

In the present invention, the coverage rate X is calculated by subjecting the image obtained by the approach described above to binary coded processing with the following analysis software. At this time, the one screen is divided into 12 squares and each square is analyzed. Conditions under which the analysis is performed with the image analysis software Image-Pro Plus ver. 5.0 are as described below.

Software Image-Pro Plus 5.1J

"Count/Size" and "Options" are selected from the "Measurement" of a tool bar in the stated order to set binarization conditions. "8-Connect" is selected in an object extraction option and "Smoothing" is set to 0. In addition, "Pre-Filter", "Fill Holes", and "Convex Hull" are not selected, and "Clean Borders" is set to "None." "Measurement item" is selected from the "Measurement" of the tool bar and "2 to 107" is input to an area screening range.

The coverage rate is calculated by surrounding a square region. At this time, the surrounding is performed so that an area (C) of the region may be 24,000 to 26,000 pixels. Automatic binarization is performed by "Processing"-binarization to calculate a total sum (D) of the areas of silica-free regions.

A coverage rate X is determined from the area C of the square region and the total sum D of the areas of the silica-free regions by using the following equation.

$$\text{Coverage rate } X(\%)=100-(D/C\times 100)$$

The average of all obtained data is defined as the coverage rate X in the present invention.

[Calculation of Sticking Ratio of Silica Fine Particles]

The sticking ratio of the silica fine particles is calculated from the amount of the silica fine particles in the toner in an ordinary state and the amount of the silica fine particles remaining after the removal of the silica fine particles not stuck to the surface of the toner.

(1) Removal of Inorganic Fine Particles that are not Stuck

The inorganic fine particles that are not stuck are removed as described below.

160 Grams of sucrose are added to 100 ml of ion-exchanged water and are dissolved therein while being warmed with hot water to prepare a sucrose solution. A solution prepared by adding 23 ml of the sucrose solution and 6.0 ml of a nonionic surfactant, preferably Contaminon N (manufactured by Wako Pure Chemical Industries, Ltd.: trade name) is charged into a 50-ml sample bottle made of polyethylene that can be sealed, 1.0 g of a measurement sample is added to the solution, and the mixture is stirred by lightly shaking the sealed bottle. After that, the bottle is left at rest for 1 hour. The sample that has been left at rest for 1 hour is shaken with a KM Shaker (Iwaki Sangyo: trade name) at 350 spm for 20 minutes. At this time, the angle at which the sample is shaken is as follows: when the directly upward direction (vertical) of the shaker is defined as 0°, a strut to be shaken is adapted to move forward by 15° and to move backward by 20°. The sample bottle is fixed to a fixing holder (obtained by fixing the lid of the sample bottle onto the extension of the center of the strut) attached to the tip of the strut. The shaken sample is quickly transferred to a container for centrifugation. The sample that has been transferred to the container for centrifugation is centrifuged with a high-speed refrigerated centrifuge H-9R (manufactured by KOKUSAN Co., Ltd.: trade name) under the following conditions: a preset temperature is 20° C., a time period for acceleration and deceleration is the shortest, the number of rotations is 3,500 rpm, and a time of rotation is 30 minutes. The toner separated in the uppermost portion is recovered and filtered with a vacuum filter, followed by drying with a dryer for 1 hour or more.

The sticking ratio is calculated from the following equation.

$$\text{Sticking ratio } [A]=\{1-(P1-P2)/P1\}\times 100$$

(In the equation, P1 represents the $SiO_2$ amount (mass %) of the initial toner and P2 represents the $SiO_2$ amount (mass %) of the toner after the removal of the silica fine particles not stuck to the surface of the toner by the above-mentioned approach. The $SiO_2$ amount of the toner is calculated by drawing a calibration curve from the $SiO_2$ intensity of the toner determined by XRF (X-ray Fluorescence) measurement.)

[Calculation of Particle Diameter of Silica Fine Particles]

The number-average particle diameter of the primary particles of the silica fine particles is calculated from an image of the surface of the toner photographed with a Hitachi ultra-high resolution field-emission scanning electron microscope S-4800 (Hitachi High-Technologies Corporation). Conditions under which the image is photographed with the S-4800 are as described below.

The operations from (1) to (2) are performed in the same manner as in the section "calculation of coverage rate X," and the surface of the toner is brought into focus in the same manner as in the operation (3) by performing focus adjustment at a magnification of 50,000. After that, brightness adjustment is performed according to the ABC mode. After that, the magnification is set to 100,000, and then focus adjustment is performed with the focus knob and the STIGMA/ALIGNMENT knob in the same manner as in the operation (3). Further, focusing is performed by autofocusing. Focusing is performed at a magnification of 100,000 by repeating the focus adjustment operation again.

After that, the particle diameters of at least 300 inorganic fine particles on the surface of the toner are measured and the number-average particle diameter of the primary particles is determined. In this case, some of the silica fine particles exist as an agglomerated lump. Accordingly, the maximum diameter of the silica fine particle that can be identified as a primary particle is determined, and the number-average particle diameter of the primary particles is obtained by taking the arithmetic average of the resultant maximum diameters.

<Measurement Method for Weight Average Particle Diameter (D4)>

The weight average particle diameter (D4) of toner particles is calculated through analysis of measurement data obtained by measurement with 25000 effective measurement channels by using a precision particle diameter distribution measuring apparatus equipped with a 100 μm aperture tube and employing an aperture electric resistance method, "Coulter Counter Multisizer 3" (registered trademark, manufactured by Beckman Coulter, Inc.) and accompanying dedicated software for setting measurement conditions and analyzing measurement data, "Beckman Coulter Multisizer 3 Version 3.51" (manufactured by Beckman Coulter, Inc.).

As an aqueous electrolyte solution for used in the measurement, one obtained by dissolving special grade sodium chloride in ion-exchanged water into a concentration of approximately 1% by mass, such as "ISOTON II" (manufactured by Beckman Coulter, Inc.), can be used.

Incidentally, before the measurement and analysis, the dedicated software is set as follows.

In a "screen for changing standard operation method (SOM)" of the dedicated software, the total count number in the control mode is set to 50000 particles, the number of measurements is set to one, and a Kd value is set to a value obtained by using "standard particles of 10.0 μm" (Beckman Coulter, Inc.). A threshold value and noise level are automatically set by pressing a threshold value/noise level measurement button. In addition, the current is set to 1600 μA, the gain is set to 2, the aqueous electrolyte solution is set to ISOTON II, and a check is put in an item of aperture tube flush to be performed after the measurement.

In a "screen for setting conversion from pulses to particle size" of the dedicated software, a bin interval is set to logarithmic particle size, the number of particle size bins is set to 256, and a particle size range is set to 2 μm to 60 μm.

The measurement method is specifically performed as follows.

1. Approximately 200 ml of the above-described aqueous electrolyte solution is put in a 250 ml round bottom glass beaker intended for use with Multisizer 3 and the beaker is placed in a sample stand and counterclockwise stirring with a stirrer rod is carried out at 24 rotations per second. Contamination and air bubbles within the aperture tube have precedently been removed by an "aperture flush" function of the analysis software.

2. Approximately 30 ml of the above-described aqueous electrolyte solution is put in a 100 ml flat bottom glass beaker, and to this beaker, approximately 0.3 ml of a dilution prepared by three-fold by mass dilution with ion-exchanged water of "Contaminon N" (a 10 mass % aqueous solution of a neutral pH 7 detergent for cleaning precision measurement instruments, containing a nonionic surfactant, an anionic surfactant and an organic builder, manufactured by Wako Pure Chemical Industries, Ltd.) is added as dispersant.

3. In an "Ultrasonic Dispersion System Tetora 150" (Nikkaki Bios Co., Ltd.), that is, an ultrasonic disperser with an electrical output of 120 W equipped with two oscillators of oscillation frequency of 50 kHz disposed with their phases displaced by 180°, a prescribed amount of ion-exchanged water is introduced into a water tank of the ultrasonic disperser and approximately 2 ml of the Contaminon N is added to the water tank.

4. The beaker described in the item 2. is set into a beaker holder hole of the ultrasonic disperser and the ultrasonic disperser is started. The height of the beaker is adjusted in such a manner that the resonant state of the surface of the aqueous electrolyte solution within the beaker is at the maximum level.

5. With the aqueous electrolyte solution within the beaker set as described in the item 4. irradiated with ultrasonic waves, approximately 10 mg of toner particles is added to the aqueous electrolyte solution in small aliquots to be dispersed therein. The ultrasonic dispersion treatment is continued for another 60 seconds. Incidentally, the water temperature in the water tank is appropriately controlled during the ultrasonic dispersion to be 10° C. or more and 40° C. or less.

6. The aqueous electrolyte solution containing the dispersed toner particles as described in the item 5. is added, by using a pipette, dropwise into the round bottom beaker set in the sample stand as described in the item 1. so as to make adjustment for attaining a measurement concentration of approximately 5%. The measurement is then performed until the number of measured particles reaches 50000.

7. The measurement data is analyzed by the above-described dedicated software accompanying the apparatus, and the weight average particle diameter (D4) is calculated. Incidentally, an "average size" shown in an analysis/volume statistical value (arithmetic mean) screen with graph/volume % set in the dedicated software corresponds to the weight average particle diameter (D4).

<Method of Measuring Average Circularity of Toner Particles>

The average circularity of the toner particles is measured with the "FPIA-3000" (Sysmex Corporation), a flow-type particle image analyzer, using the measurement and analysis conditions from the calibration process.

The method of measurement is as follows. First, about 20 mL of ion-exchanged water from which solid impurities have been removed is placed in a glass vessel. Next, about 0.2 mL of a dilution prepared by diluting Contaminon N (a 10 wt % aqueous solution of a neutral (pH 7) cleanser for cleaning precision analyzers which is composed of a nonionic surfactant, an anionic surfactant and an organic builder; available from Wako Pure Chemical Industries, Ltd.) with an approximately 3-fold weight of ion-exchanged water is added to this as the dispersant. About 0.02 g of the measurement sample is then added and dispersion treatment is carried out for 2 minutes using an ultrasonic disperser, thereby forming a dispersion for measurement. The dispersion is suitably cooled at this time to a temperature of at least 10° C. and not more than 40° C. Using a desktop ultrasonic cleaner/disperser (e.g., VS-150 from Velvo-Clear) having a oscillation frequency of 50 kHz and an electrical output of 150 W as the ultrasonic disperser, a given amount of ion-exchanged water was placed in the water tank and about 2 mL of Contaminon N was added to this tank.

Measurement was carried out using a flow-type particle image analyzer equipped with, as the object lens, a "UPlanApro" (enlargement, 10×; numerical aperture, 0.40), and using the particle sheath "PSE-900A" (from Sysmex Corporation) as a sheath reagent.

The dispersion prepared according to the procedure described above was introduced to the flow-type particle image analyzer and, in the HPF measurement mode, 3,000 toner particles were measured in the total count mode. Next, setting the binarization threshold during particle analysis to 85%, and restricting the analyzed particle diameter to a circle-equivalent diameter of at least 1.985 μm and less than 39.69 μm, the average circularity of the toner particles was determined.

For this measurement, automatic focal point adjustment is performed prior to the start of the measurement using reference latex particles (for example, a dilution with ion-exchanged water of "RESEARCH AND TEST PARTICLES Latex Microsphere Suspensions 5200A" from Duke Scientific). It is preferable to subsequently carry out focal point adjustment every 2 hours following the start of measurement.

In this invention, use is made of a flow-type particle image analyzer for which the calibration work by Sysmex Corporation was carried out and for which a calibration certification issued by Sysmex Corporation was received. Aside from limiting the diameters of the analyzed particle to a circle-equivalent diameter of at least 1.985 μm and less than 39.69 μm, measurement is carried out under the measurement and analysis conditions at the time that the calibration certificate was received.

The measurement principle employed in the FPIA-3000 (from Sysmex Corporation) flow-type particle image analyzer is to capture the flowing particles as still images and carry out image analysis. The sample that has been added to the sample chamber is fed to a flat sheath flow cell with a sample suctioning syringe. The sample fed into the flat sheath flow cell is sandwiched between the sheath reagent, forming a flattened flow.

The sample passing through the flat sheath flow cell is irradiated at 1/60-second intervals with a strobe light, enabling the flowing particles to be captured as still images. Because the flow is flattened, the images are captured in a focused state. The particle images are captured with a CCD camera, and the captured images are image processed with a 512×512 pixel image processing resolution (0.37 μm×0.37 μm per pixel), following which contour extraction is carried out on each particle image, and the projected area S, periphery length L and the like for the particle image are calculated.

Next, the circle-equivalent diameter and circularity are determined using the above surface area S and periphery length L. The circle-equivalent diameter is the diameter of the circle that has the same area as the projected area of the particle image.

The circularity is defined as the value provided by dividing the circumference of the circle determined from the circle-equivalent diameter by the periphery length of the particle's projected image and is calculated using the following formula.

$$\text{Circularity}=2\times(\pi\times S)^{1/2}/L$$

When the particle image is circular, the circularity is 1.000. As the degree of unevenness in the circumference of the particle image becomes larger, the circularity value becomes smaller. After calculating the circularity of each particle, the range in circularity from 0.200 to 1.000 is divided by 800, the arithmetic mean of the resulting circularities is calculated, and the resulting value is treated as the average circularity.

Next, the basic configuration of an image forming apparatus in which the developer replenishing cartridge of the present invention is used is described. Subsequently, the configurations of developer replenishing systems to be mounted to the image forming apparatus, in other words, a developer replenishing apparatus and a developer replenishing kit are sequentially described.

(Image Forming Apparatus)

Figure 2:
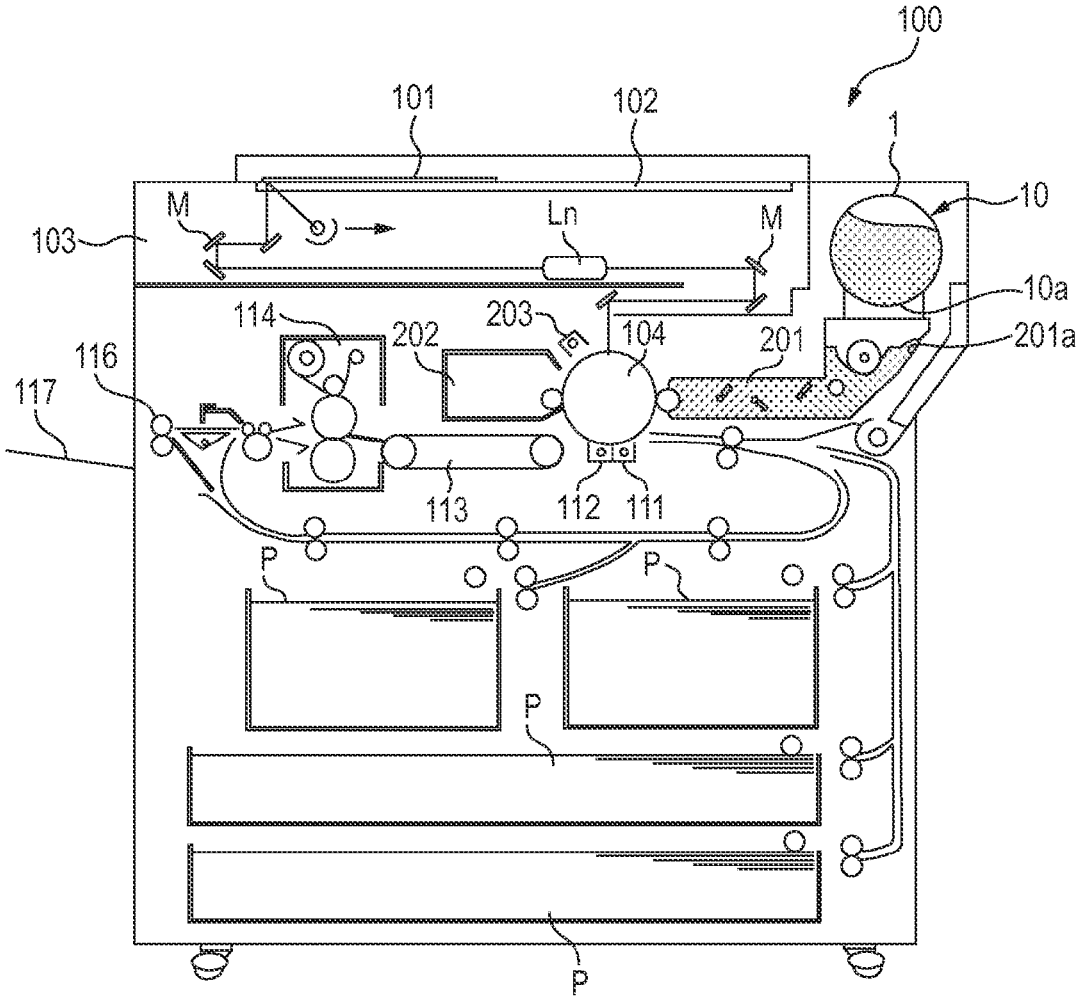
FIG. 2 is a sectional view illustrating the entire configuration of an image forming apparatus.

The configuration of a copying machine adopting an electrophotographic system (electrophotographic image forming apparatus) is described as an example of an image forming apparatus mounted with a developer replenishing apparatus to which the developer replenishing cartridge is removably mountable with reference to FIG. 2.

In FIG. 2, a copying machine main body (hereinafter referred to as "image forming apparatus main body" or "apparatus main body") is represented by reference numeral 100. In addition, an original 101 is set on an original stage glass 102. Then, an electrostatic latent image is formed by imaging an optical image according to the image information of the original on an electrophotographic photosensitive member 104 (hereinafter referred to as "photosensitive member") with multiple mirrors M and a lens Ln of an optical portion 103. The electrostatic latent image is visualized with toner as a developer by a dry developing device 201*a*.

A transfer charging device and a separation charging device are represented by reference numerals 111 and 112, respectively. Here, the image formed with the developer on the photosensitive member 104 is transferred onto a sheet P by the transfer charging device 111. Then, the sheet P onto which the developer image (toner image) has been transferred is separated from the photosensitive member 104 by the separation charging device 112.

After that, the sheet P conveyed by a conveying portion 113 reaches a fixing portion 114 where the developer image on the sheet is fixed by heat and pressure. After that, the sheet is discharged by a discharge roller 116 to a discharge tray 117.

In the apparatus main body 100 of the configuration, image forming process devices such as the developing device 201*a* as a developing unit, a cleaner portion 202 as a cleaning unit, and a primary charging device 203 as a charging unit are set around the photosensitive member 104. It should be noted that the developing device 201*a* develops the electrostatic latent image, which is formed on the photosensitive member 104 by the optical portion 103 based on the image information of the original 101, by causing the developer to adhere to the image. In addition, the primary charging device 203 is intended for uniform charging of the surface of the photosensitive member in order that a desired electrostatic image may be formed on the photosensitive member 104. In addition, the cleaner portion 202 is intended for the removal of the developer remaining on the photosensitive member 104.

(Developer Replenishing Apparatus)

Figure 3:
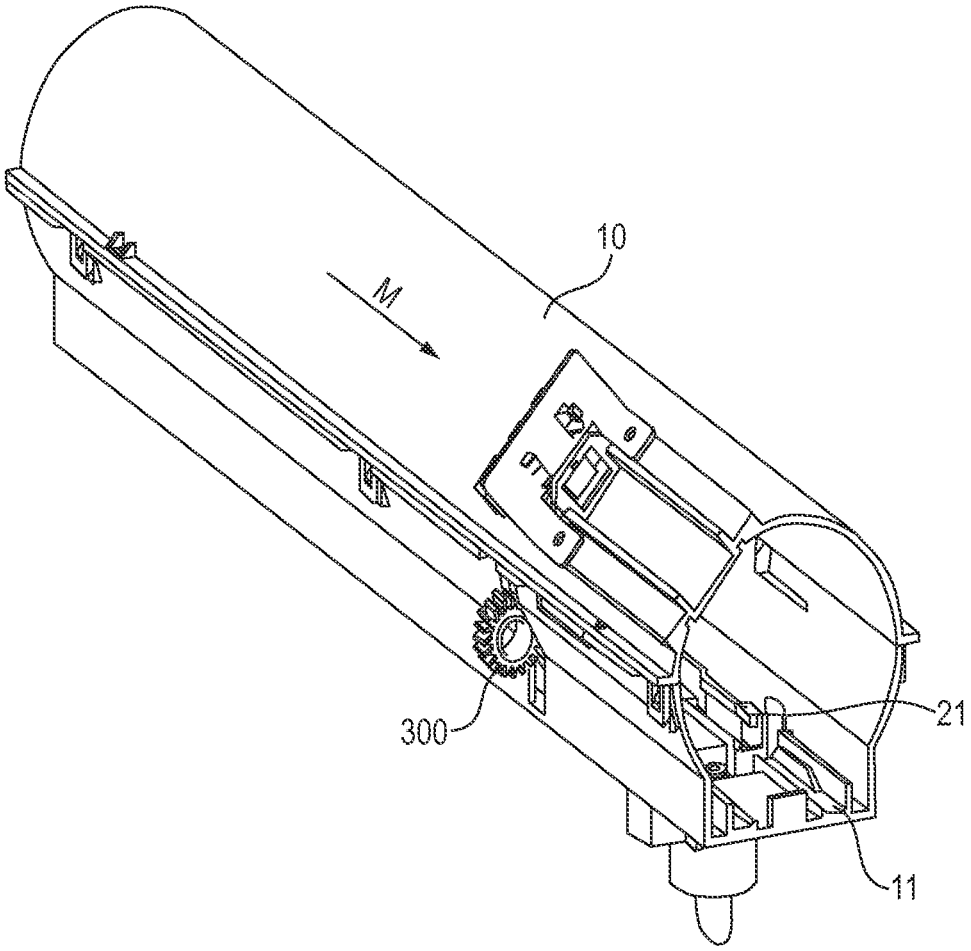
FIG. 3 is a perspective view of a mounting portion.
Figure 4A:
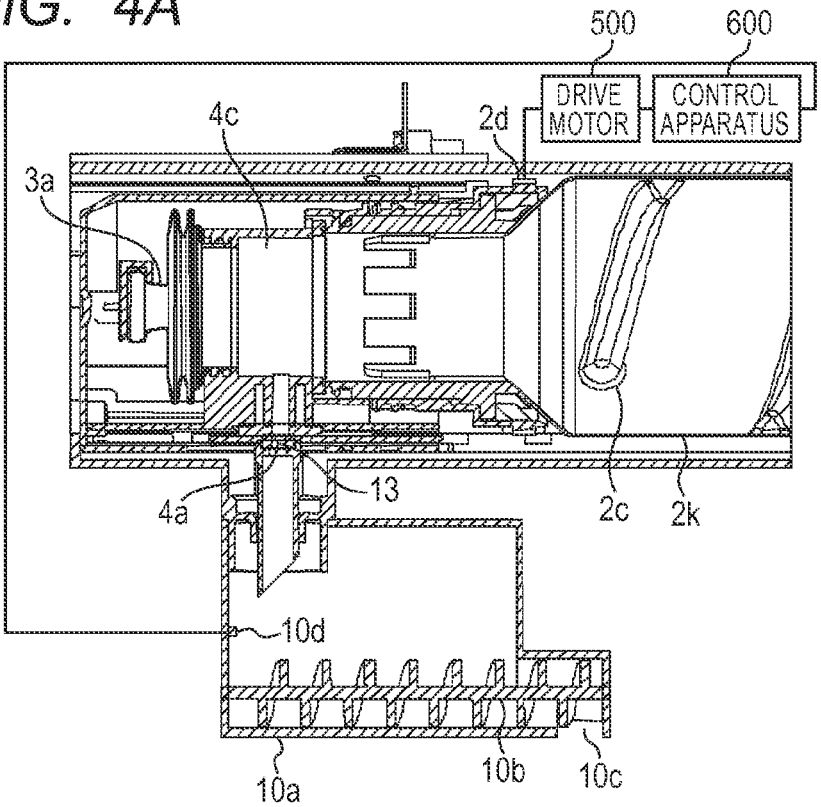
FIG. 4A and FIG. 4B are enlarged sectional views illustrating a developer replenishing container and a developer replenishing apparatus.
Figure 4B:
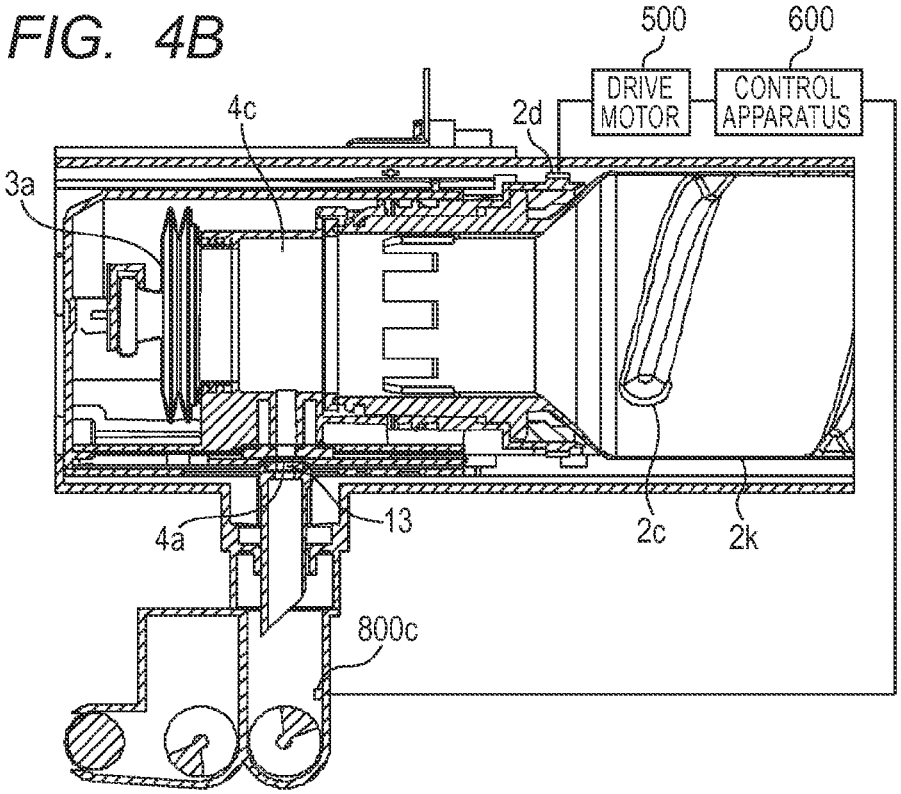

Next, a developer replenishing apparatus 201 is described with reference to FIG. 2 to FIGS. 4A and 4B. FIG. 3 illustrates a perspective view of a mounting portion 10 to which a developer replenishing container 1 constituting the developer replenishing cartridge is mounted. It should be noted that the developer replenishing cartridge has a developer containing portion for containing the developer and the developer contained in the developer containing portion. In addition, FIGS. 4A and 4B illustrate a partially enlarged sectional view of a control system, and the developer replenishing container 1 and the developer replenishing apparatus 201.

As illustrated in FIG. 2, the developer replenishing apparatus 201 includes: the mounting portion (mounting space) 10, to which the developer replenishing container 1 is removably mountable; a hopper 10*a* for temporarily reserving the developer discharged from the developer replenishing container 1; and the developing device 201*a*.

In addition, as illustrated in FIG. 3, the mounting portion 10 is provided with a rotation direction restricting portion (retaining mechanism) 11 for restricting the movement of a flange portion 4 of the developer replenishing container 1 (see FIG. 8C) to a rotation direction by abutting on the flange portion 4 upon mounting of the developer replenishing container 1.

In addition, the mounting portion 10 includes a developer receiving port (developer receiving hole) 13 for receiving the developer discharged from the developer replenishing container 1 by communicating with a discharge port (discharge hole) 4*a* of the developer replenishing container 1 to be described later (see FIGS. 4A and 4B) upon mounting of the developer replenishing container 1. Then, the developer is supplied from the discharge port 4*a* of the developer replenishing container 1 to the developing device 201*a* through the developer receiving port 13. It should be noted that in this example, the diameter ϕ of the developer receiving port 13 is set to 3 mm comparable to a fine port (pinhole) for the purpose of preventing the contamination of the inside of the mounting portion 10 with the developer to the extent possible. It should be noted that the diameter of the developer receiving port has only to be such a diameter that the developer can be discharged from the discharge port 4*a*.

In addition, as illustrated in FIG. 4A, the hopper 10*a* has a conveying screw 10*b* for conveying the developer to the developing device 201*a*, an opening 10*c* communicating with the developing device 201*a*, and a developer sensor 10*d* for detecting the amount of the developer contained in the hopper 10*a*.

Further, as illustrated in FIG. 3, the mounting portion 10 includes a drive gear 300 that functions as a drive mechanism (drive portion). A rotation drive force is transmitted from a drive motor 500 (not shown) to the drive gear 300 through a drive gear train, and the gear has a function of applying the rotation drive force to the developer replenishing container 1 in a state of being set in the mounting portion 10.

In addition, as illustrated in FIG. 4B, the drive motor 500 is configured so that its operation may be controlled by a controlling apparatus (CPU) 600 (not shown). As illustrated in FIG. 4A, the controlling apparatus 600 is configured to control the operation of the drive motor 500 based on information about the remaining amount of the developer input from the developer sensor 10*d*.

It should be noted that in this example, the drive gear 300 is set to rotate only in one direction in order that the control of the drive motor 500 may be facilitated. In other words, the controlling apparatus 600 is configured to control only the ON (operation)/OFF (non-operation) of the drive motor 500.

(Developer Replenishment Control by Developer Replenishing Apparatus)

Next, developer replenishment control by the developer replenishing apparatus 201 is described. The developer replenishment control is performed by controlling various devices with the controlling apparatus (CPU).

In this example, the following configuration is adopted: the controlling apparatus 600 controls the operation/non-operation of the drive motor 500 according to an output from the developer sensor 10*d*, whereby more than a certain amount of the developer is prevented from being contained in the hopper 10*a*.

Specifically, first, the developer sensor 10*d* checks the content of the developer in the hopper 10*a*. Then, when the content of the developer detected by the developer sensor 10*d* is judged to be less than a predetermined amount, in other words, when the developer is not detected by the developer sensor 10*d*, a developer replenishing operation is performed for a certain time period by driving the drive motor 500.

When the content of the developer detected by the developer sensor 10*d* is judged to have reached the predetermined amount as a result of the developer replenishing operation, in other words, when the developer is detected by the developer sensor 10*d*, the developer replenishing operation is stopped by turning the driving of the drive motor 500 off. A series of developer replenishing steps is completed by the stopping of the replenishing operation.

Such developer replenishing step is adapted to be repeatedly performed when the content of the developer in the hopper 10*a* becomes less than the predetermined amount owing to the consumption of the developer in association with image formation.

Although such configuration that the developer discharged from the developer replenishing container 1 is temporarily reserved in the hopper 10*a* and then the developing device 201*a* is replenished with the developer as described above is permitted, such a configuration as described below is adopted for the developer replenishing apparatus 201 in this example.

As described later, in this example, the developer in the developer replenishing container 1 is hardly discharged from the discharge port 4*a* only by gravity action, and the developer is discharged by a volume changing operation by a pump portion 3*a*, and hence a variation in discharge amount can be suppressed. Accordingly, even in such an example as illustrated in FIG. 4B from which the hopper 10*a* has been omitted, a development chamber can be stably replenished with the developer.

(Developer Replenishing Container)

Figure 5A:
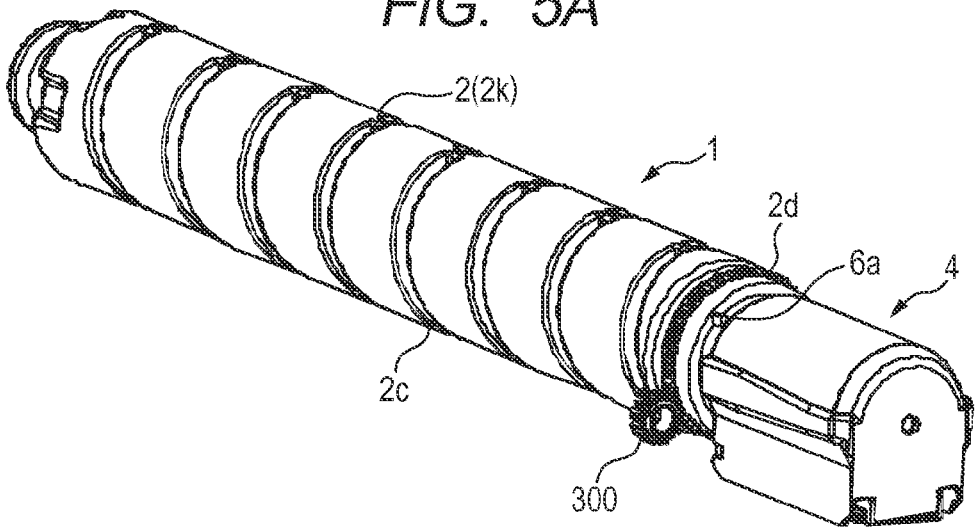
FIG. 5A is a perspective view illustrating a developer replenishing container according to Example 1.
Figure 5B:
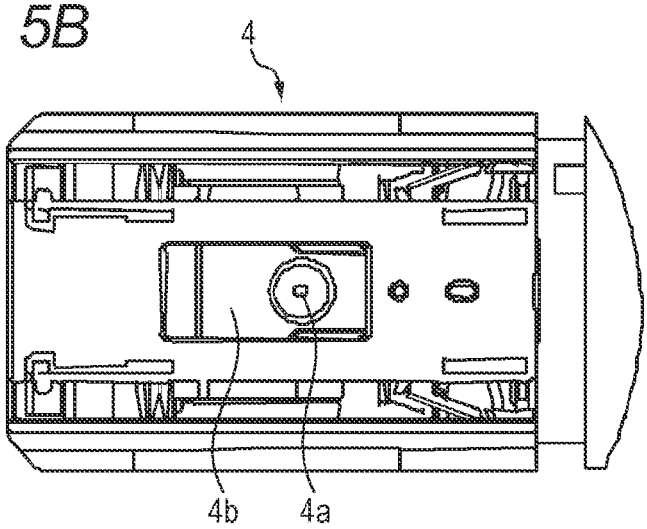
FIG. 5B is a partially enlarged view illustrating an appearance around a discharge port.
Figure 5C:
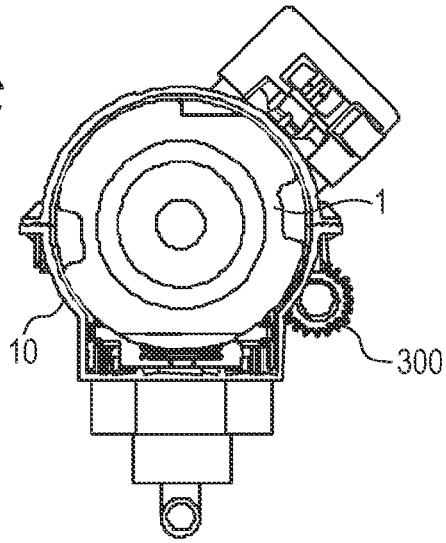
FIG. 5C is a front view illustrating a state where the developer replenishing container is mounted to the mounting portion of the developer replenishing apparatus.
Figure 6:
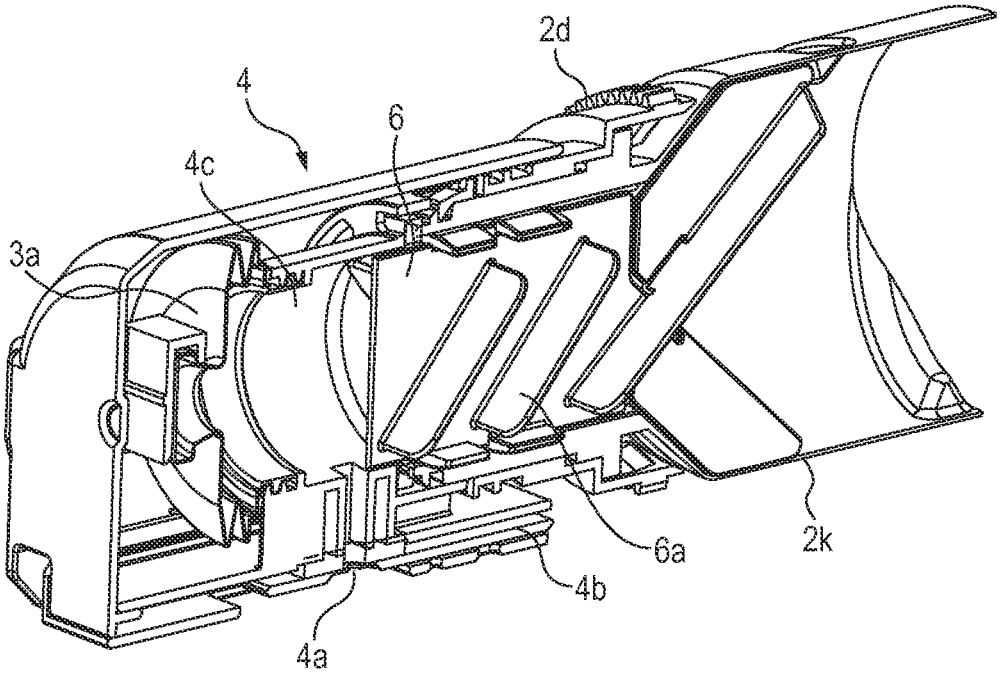
FIG. 6 is a sectional perspective view of the developer replenishing container.

Next, the configuration of the developer replenishing container 1 is described with reference to FIGS. 5A to 5C to 7A and 7B. FIG. 5A is an entire perspective view of the developer replenishing container 1, FIG. 5B is a partially enlarged view of the vicinity of the discharge port 4*a* of the developer replenishing container 1, and FIG. 5C is a front view illustrating a state where the developer replenishing container 1 is mounted to the mounting portion 10. In addition, FIG. 6 is a sectional perspective view of the developer replenishing container, FIG. 7A is a partial sectional view of a state where the pump portion 3*a* is maximally expanded at the time of its use, and FIG. 7B is a partial sectional view of a state where the pump portion 3*a* is maximally contracted at the time of the use.

As illustrated in FIG. 5A, the developer replenishing container 1 includes a developer containing portion 2 (also referred to as "container main body") formed into a hollow cylindrical shape and including in itself an internal space for containing the developer. In this example, a cylindrical portion 2*k*, a discharge portion 4*c* (see FIG. 4B), and the pump portion 3*a* (see FIGS. 5A to 5C) function as the developer containing portion 2. Further, the developer replenishing container 1 includes the flange portion 4 (also referred to as "non-rotary portion") on one end side in the longitudinal direction (developer conveying direction) of the developer containing portion 2. In addition, the cylindrical portion 2*k* is configured to be capable of rotating relative to the flange portion 4. It should be noted that the sectional shape of the cylindrical portion 2*k* may be a noncircular shape to the extent that a rotation operation in the developer replenishing step is not affected. For example, an elliptical shape or a polygonal shape may be adopted.

Figure 7A:
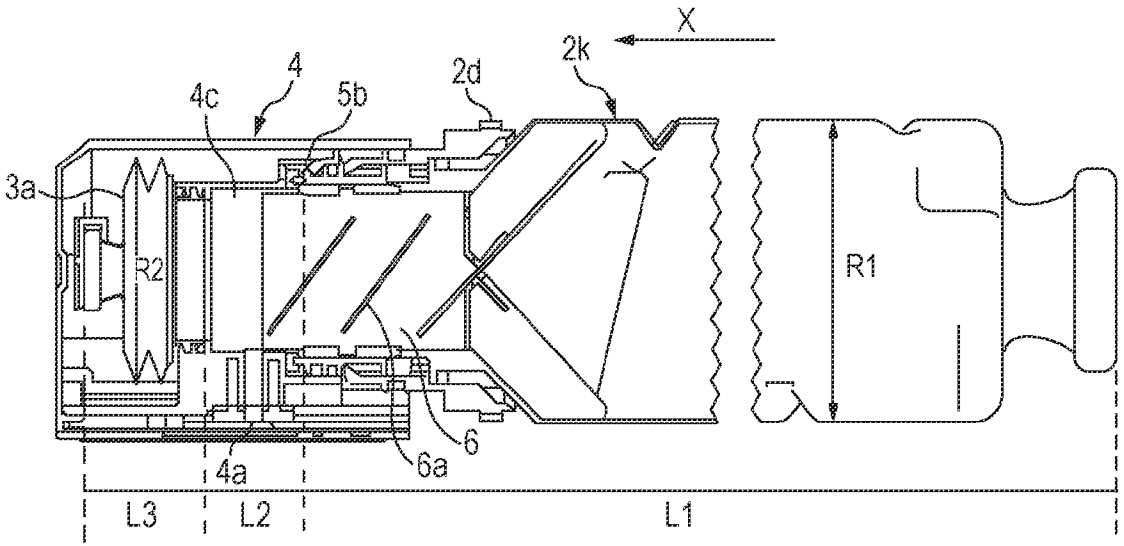
FIG. 7A is a partial sectional view of a state where a pump portion is maximally expanded at the time of its use and FIG. 7B is a partial sectional view of a state where the pump portion is maximally contracted at the time of the use.
Figure 7B:
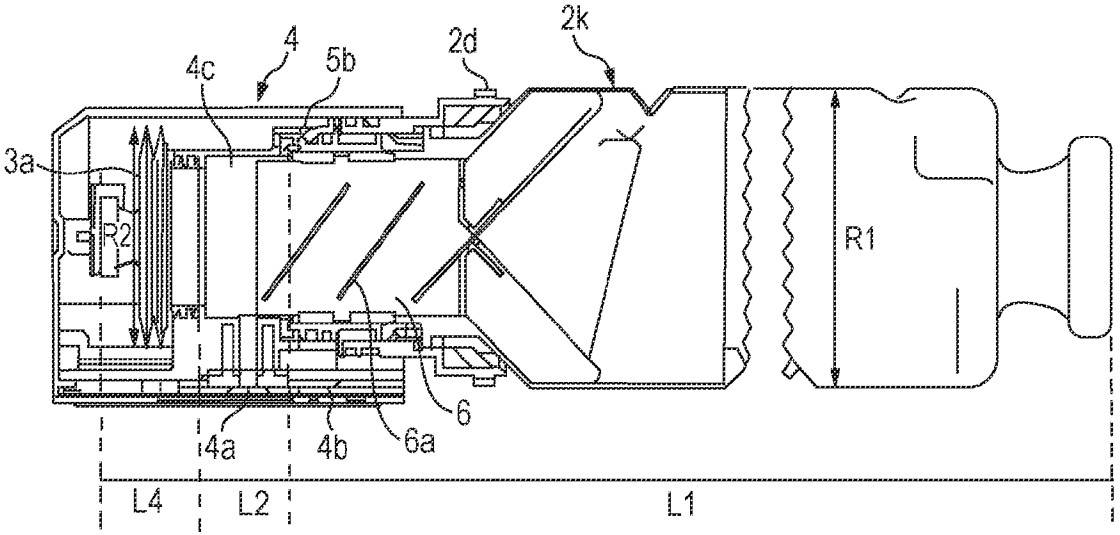

It should be noted that in this example, as illustrated in FIG. 7A, a total length L1 and outer diameter R1 of the cylindrical portion 2*k* functioning as a developer containing chamber are set to about 460 mm and about 60 mm, respectively. In addition, a length L2 of a region where the discharge portion 4*c* functioning as a developer discharge chamber is set is about 21 mm, a total length L3 of the pump portion 3*a* (in a state of being most expanded in an expandable range at the time of the use) is about 29 mm, and as illustrated in FIG. 7B, a total length L4 of the pump portion 3*a* (in a state of being most contracted in the expandable range at the time of the use) is about 24 mm.

In addition, in this example, the following configuration is adopted: in a state where the developer replenishing container 1 is mounted onto the developer replenishing apparatus 201, the cylindrical portion 2*k* and the discharge portion 4*c* are set in horizontal alignment as illustrated in FIGS. 5A to 5C and FIG. 6. In other words, the cylindrical portion 2*k* is configured so that its length in the horizontal direction may be sufficiently long as compared to its length in a vertical direction and a side thereof in the horizontal direction may be connected to the discharge portion 4*c*. Therefore, the amount of the developer present on the discharge port 4*a* to be described later can be reduced as compared to that in the case where the following configuration is adopted: in the state where the developer replenishing container 1 is mounted onto the developer replenishing apparatus 201, the cylindrical portion 2*k* is positioned vertically above the discharge portion 4*c*. Accordingly, the developer near the discharge port 4*a* is hardly consolidated, and hence intake and exhaust operations can be smoothly performed.

(Material for Developer Replenishing Container)

In this example, the following configuration is adopted: the developer is discharged from the discharge port 4*a* by changing a volume in the developer replenishing container 1 with the pump portion 3*a* as described later. Accordingly, the following material is preferably adopted as a material for the developer replenishing container 1: a material having such rigidity that the material neither largely collapses nor largely swells owing to the change of the volume.

In addition, in this example, the developer replenishing container 1 is configured to communicate with the outside only through the discharge port 4*a* and to be sealed from the outside except for the discharge port 4*a*. In other words, such airtightness that stable discharge performance is maintained is required because the following configuration is adopted: the developer is discharged from the discharge port 4*a* by reducing or increasing the volume of the developer replenishing container 1 with the pump portion 3*a*.

In view of the foregoing, in this example, a material for each of the developer containing portion 2 and the discharge portion 4*c* is a polystyrene resin, and a material for the pump portion 3*a* is a polypropylene resin.

It should be noted that the material to be used for each of the developer containing portion 2 and the discharge portion 4*c* has only to be a material capable of resisting the volume change. For example, other resins such as an acrylonitrile-butadiene-styrene copolymer (ABS), polyester, polyethylene, and polypropylene can each be used. In addition, the portions may each be made of a metal.

In addition, the material for the pump portion 3*a* has only to be a material that exhibits an expanding and contracting function, and can change the volume of the developer replenishing container 1 through the change of its volume. For example, a thin-walled product formed of ABS, polystyrene, polyester, or polyethylene may be used. In addition, rubber, other expandable materials, and the like can each be used.

Note that, as long as the above-mentioned respective functions of the pump portion 3*a*, the developer containing portion 2, the discharge portion 4*c* can be secured, for example, through adjustment in thickness of resin materials, those components may be integrally made of the same material, for example, through an injection molding method or a blow molding method.

Now, structures of the flange portion 4, the cylindrical portion 2*k*, the pump portion 3*a*, a drive receiving mechanism 2*d*, and a drive conversion mechanism 2*e* (cam groove) are sequentially described in detail.

(Flange Portion)

As illustrated in FIG. 6, the flange portion 4 is provided with the hollow discharge portion (developer discharge chamber) 4*c* for temporarily pooling the developer conveyed from an inside of the cylindrical portion (developer containing chamber) 2*k*. The discharge portion 4*c* includes a bottom portion provided with the small discharge port 4*a* for allowing the developer to be discharged to the outside of the developer replenishing container 1, in other words, for replenishing the developer to the developer replenishing apparatus 201. A size of the discharge port 4*a* is described in detail below.

Further, the flange portion 4 is provided with a shutter 4*b* for opening and closing the discharge port 4*a*. The shutter 4*b* is configured to abut on an abutment member (see FIG. 3 as required) provided to the mounting portion 10 at the time of an operation of mounting the developer replenishing container 1 to the mounting portion 10. Thus, along with the operation of mounting the developer replenishing container 1 to the mounting portion 10, the shutter 4*b* slides relatively to the developer replenishing container 1 in a rotation axis direction of the cylindrical portion 2*k* (direction opposite to a direction M). As a result, the discharge port 4*a* is exposed from the shutter 4*b*, and an unsealing operation is completed.

At this time point, the discharge port 4*a* is aligned with the developer receiving port 13 of the mounting portion 10, and hence communication therebetween is established. In this state, the developer can be replenished from the developer replenishing container 1.

Further, the flange portion 4 is configured to be substantially immovable after the developer replenishing container 1 is mounted onto the mounting portion 10 of the developer replenishing apparatus 201.

Specifically, the rotation direction restricting portion 11 illustrated in FIG. 3 is provided so that the flange portion 4 is not rotated by itself in a rotation direction of the cylindrical portion 2*k*.

Thus, under a state where the developer replenishing container 1 is mounted onto the developer replenishing apparatus 201, the discharge portion 4*c* provided to the flange portion 4 is also substantially hindered from being rotated in the rotation direction of the cylindrical portion 2*k* (except movements as large as backlash).

Meanwhile, the cylindrical portion 2*k* is configured to be rotated in the developer replenishing step without being restricted in the rotation direction by the developer replenishing apparatus 201.

Further, as illustrated in FIG. 7A, there is provided a plate-like partition wall 6 for conveying the developer, which is conveyed through intermediation of a helical projecting portion (conveying portion) 2*c* from the cylindrical portion 2*k*, to the discharge portion 4*c*. The partition wall 6 is provided to substantially bisect a part of a region in the developer containing portion 2, and configured to be rotated integrally with the cylindrical portion 2*k*. In addition, the partition wall 6 has both surfaces each provided with inclined protrusions 6*a* inclined with respect to a rotation axis direction of the developer replenishing container 1. The inclined protrusions 6*a* are connected to an inlet portion of the discharge portion 4*c*.

Thus, the developer conveyed by the conveying portion 2*c* is thrust from bottom to top in a gravity direction by the partition wall 6 in conjunction with the rotation of the cylindrical portion 2*k*. Then, along with a further rotation of the cylindrical portion 2*k*, the developer flows off with gravity from a surface of the partition wall 6, and then is transferred to the discharge portion 4*c* side by the inclined protrusions 6*a*. The inclined protrusions 6*a* are provided to both the side surfaces of the partition wall 6 so as to feed the developer into the discharge portion 4*c* per half rotation of the cylindrical portion 2*k*.

(Discharge Port of Flange Portion)

In this embodiment, a size of the discharge port 4*a* of the developer replenishing container 1 is set to prevent the developer from being sufficiently discharged only by gravity action when the developer replenishing container 1 assumes a posture of replenishing the developer to the developer replenishing apparatus 201. In other words, an opening size of the discharge port 4*a* is set small enough to prevent the developer from being sufficiently discharged from the developer replenishing container only by the gravity action (also referred to as pore (pinhole)). In other words, the size of the opening is set so that the discharge port 4*a* is closed substantially by the developer. With this, the following effects can be expected.

(1) The developer is less liable to leak through the discharge port 4*a*.

(2) The developer can be suppressed from being excessively discharged at the time when the discharge port 4*a* is opened.

(3) The discharge of the developer can be set to depend dominantly on the exhaust operation by the pump portion 3*a*.

Further, when the size of the discharge port 4*a* is set to be small, the following effects can also be obtained.

When the developer is replenished to the image forming apparatus, the developer adheres to the discharge port 4*a* of the developer replenishing container 1 and a peripheral portion of the developer receiving port 13. Thus, when the size of the discharge port 4*a* is set to be large, a circumference of a rim of the opening increases. Thus, the developer adheres in a wider range, with the result that fouling is liable to occur. In other words, as a method of suppressing the fouling, it is appropriate to downsize the discharge port 4*a*.

In this embodiment, the size of the discharge port 4*a* of the developer replenishing container 1 is set to ϕ4 mm (area of 12.6 $mm^2$) or less. The size of the discharge port 4*a* is set to be as large as that of the pore (pinhole) so as to reduce an amount of the developer that adheres to the discharge port 4*a* of the developer replenishing container 1 and the image forming apparatus at the time of replenishing the developer to the image forming apparatus.

Meanwhile, it is preferred that a lower limit value of the size of the discharge port 4*a* be set to a value at which the developer to be replenished from the developer replenishing container 1 can at least pass therethrough. In other words, it is preferred that the discharge port be larger than a particle diameter of the developer (volume-average particle diameter of the toner, and number-average particle diameter of the carrier) contained in the developer replenishing container 1. For example, when the developer to be replenished is a two-component developer containing non-magnetic toner and magnetic carrier, it is preferred that the discharge port be larger than a larger one of the particle diameters, that is, the number-average particle diameter of the magnetic carrier in the two-component developer.

Specifically, when the non-magnetic toner (volume-average particle diameter of 5.5 μm) and the magnetic carrier (number-average particle diameter of 40 μm) are contained in the two-component developer to be replenished, it is preferred that a diameter of the discharge port 4*a* be set to 0.05 mm (opening area of 0.002 $mm^2$) or more.

Note that, when the size of the discharge port 4*a* is set close to the particle diameter of the developer, higher energy is needed to discharge the developer by a desired amount from the developer replenishing container 1, that is, to operate the pump portion 3*a*. Further, there may occur a restriction on manufacture of the developer replenishing container 1. Specifically, in a case of molding the discharge port 4*a* through a resin component by the injection molding method, a durability of a component of a die for forming a part corresponding to the discharge port 4*a* cannot be sufficiently secured. For those reasons, it is preferred that the diameter ϕ of the discharge port 4*a* be set to 0.5 mm or more.

Note that, in this embodiment, the discharge port 4*a* is formed into a circular shape, but the present invention is not limited to such a shape.

Note that, assuming the same opening area, the discharge port having the circular shape is smallest in circumference of the rim of the opening, which may foul through adhesion of the developer, among the discharge ports of any other shape. Thus, the amount of the developer that may spread in conjunction with an opening/closing operation of the shutter 4*b* is reduced, and fouling is less liable to occur. Further, the discharge port having the circular shape reduces resistance at the time of discharge, and has the highest dischargeability. Thus, it is more preferred that the discharge port 4*a* be formed into the circular shape that is best-balanced in discharge amount and fouling prevention.

In this embodiment, from the viewpoints described above, the discharge port 4*a* is formed into the circular shape, and the diameter ϕ of its opening is set to 2 mm.

Note that, as required, multiple discharge ports 4*a* may be provided. In that case, it is preferred that each opening area satisfy the range of the opening area described above.

(Cylindrical Portion)

Next, the cylindrical portion 2*k* that functions as the developer containing chamber is described with reference to FIGS. 5A to 5C and 6.

As illustrated in FIGS. 5A to 5C and 6, the cylindrical portion 2*k* has an inner surface provided with the helically projecting conveying portion 2*c* that functions as a unit for conveying, in conjunction with the rotation thereof, the developer contained therein toward the discharge portion 4*c* (discharge port 4*a*) that functions as the developer discharge chamber. Further, the cylindrical portion 2*k* is formed of the above-mentioned resin materials by the blow molding method.

Note that, in order to increase the volume of the developer replenishing container 1 so as to increase a filling amount, a method of increasing a volume of the flange portion 4 as the developer containing portion 2 in a height direction is considered. However, in such a configuration, the gravity action on the developer near the discharge port 4*a* is intensified by own weight of the developer. As a result, the developer near the discharge port 4*a* is liable to be consolidated, and hinders intake/exhaust through the discharge port 4*a*. In this case, in order to loosen the developer that is consolidated by the intake through the discharge port 4*a* or to discharge the developer through the exhaust, a volume change amount of the pump portion 3*a* needs to be further increased. However, as a result, a drive force for driving the pump portion 3*a* becomes higher, which may cause an excessive load on the image forming apparatus main body 100.

Meanwhile, in this embodiment, the cylindrical portion 2*k* is set in horizontal alignment with the flange portion 4. Thus, a thickness of a layer of the developer on the discharge port 4*a* in the developer replenishing container 1 can be set to be smaller than that in the structure described above. With this, the developer is less liable to be consolidated by the gravity action. As a result, the developer can be stably discharged without imposing a load on the image forming apparatus main body 100.

Further, as illustrated in FIGS. 7A and 7B, in a state of compressing a flange seal 5*b* of a ring-shaped sealing member provided to an inner surface of the flange portion 4, the cylindrical portion 2*k* is fixed to be rotatable relatively to the flange portion 4.

With this, the cylindrical portion 2*k* is rotated while sliding against the flange seal 5*b*, and hence the developer does not leak during the rotation. Further, the airtightness is maintained. In other words, the air is appropriately taken in and exhausted through the discharge port 4*a*. With this, the volume of the developer replenishing container 1 during replenishment can be changed as desired.

(Pump Portion)

Next, the (reciprocable) pump portion 3*a* that is changeable in volume in conjunction with reciprocation is described with reference to FIG. 6 and FIGS. 7A and 7B. FIG. 6 is a sectional perspective view of the developer replenishing container. FIG. 7A is a partial sectional view of a state where the pump portion is maximally expanded at the time of its use, and FIG. 7B is a partial sectional view of a state where the pump portion is maximally contracted at the time of its use.

The pump portion 3*a* of this embodiment functions as an intake/exhaust mechanism for performing an intake operation and the exhaust operation alternately to each other through the discharge port 4*a*. In other words, the pump portion 3*a* functions as an airflow generating mechanism for generating airflow toward an inside of the developer replenishing container and airflow from the developer replenishing container toward the outside through the discharge port 4*a* repeatedly and alternately to each other.

As illustrated in FIG. 7A, the pump portion 3*a* is provided in a direction X with respect to the discharge portion 4*c*. In other words, the pump portion 3*a* is provided so that the pump portion 3*a* is not rotated by itself together with the discharge portion 4*c* in the rotation direction of the cylindrical portion 2*k*.

Further, the pump portion 3*a* of this embodiment is capable of containing therein the developer. As described later, the developer containing space in the pump portion 3*a* exhibits an important function in fluidizing the developer at the time of the intake operation.

Then, in this embodiment, as the pump portion 3*a*, a volume-changeable-type resin pump portion (bellows pump) that is changeable in volume in conjunction with reciprocation is adopted. Specifically, as illustrated in FIG. 6 and FIGS. 7A and 7B, the adopted bellows pump includes multiple "peak" portions and multiple "valley" portions formed periodically and alternately to each other. Thus, the pump portion 3*a* can be compressed and expanded repeatedly and alternately to each other by a drive force received from the developer replenishing apparatus 201. Note that, in this embodiment, a volume change amount at the time of expansion/contraction of the pump portion 3*a* is set to 5 $cm^3$ (cc). A length L3 illustrated in FIG. 7A is set to about 29 mm, and a length L4 illustrated in FIG. 7B is set to about 24 mm. An outer diameter R2 of the pump portion 3*a* is set to about 45 mm.

When such a pump portion 3*a* is adopted, the volume of the developer replenishing container 1 can be changed repeatedly and alternately to each other at a predetermined cycle. As a result, the developer in the discharge portion 4*c* can be efficiently discharged through the discharge port 4*a* having a small diameter (diameter of about 2 mm).

(Drive Receiving Mechanism)

Next, the drive receiving mechanism (drive input portion and drive force receiving portion) of the developer replenishing container 1, which receives a rotation drive force for rotating the conveying portion 2*c* from the developer replenishing apparatus 201, is described.

As illustrated in FIG. 5A, the developer replenishing container 1 includes the gear portion 2*d* that functions as the drive receiving mechanism (drive input portion and drive force receiving portion) engageable with (drive-linkable to) the drive gear 300 (that functions as a drive mechanism) of the developer replenishing apparatus 201. The gear portion 2*d* is configured to be rotatable integrally with the cylindrical portion 2*k*.

Figure 8A:
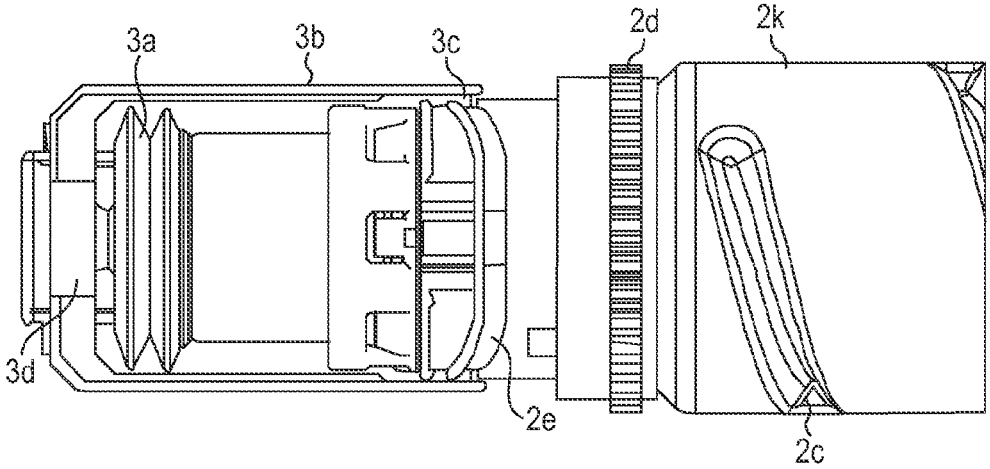
FIG. 8A is a partial view of the state where the pump portion is maximally expanded at the time of the use.
Figure 8B:
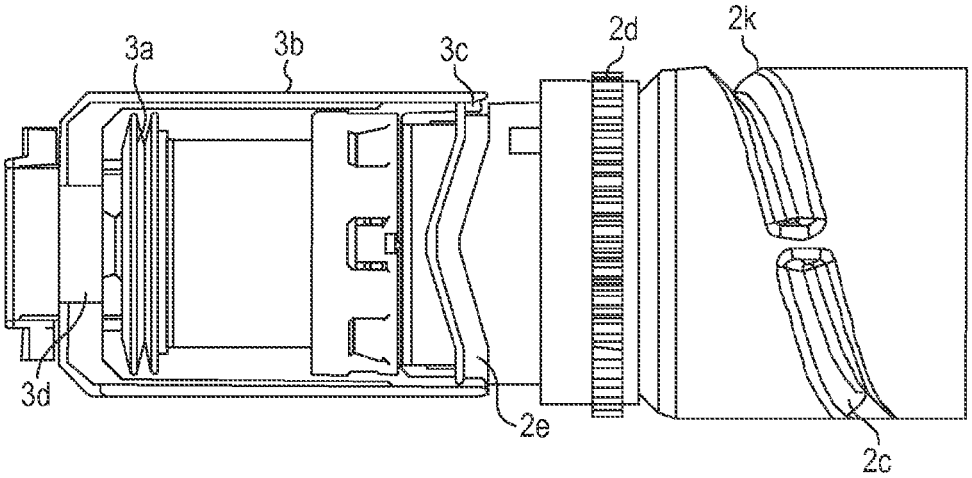
FIG. 8B is a partial view of the state where the pump portion is maximally contracted at the time of the use.

With this, the rotation drive force that is input from the drive gear 300 to the gear portion 2*d* is transmitted to the pump portion 3*a* through intermediation of a reciprocating member 3*b* illustrated in FIGS. 8A and 8B. Specifically, this mechanism is described later together with the drive conversion mechanism. The bellows pump portion 3*a* of this embodiment is manufactured by using a resin material having a torsional resistance in the rotation direction on a premise that an expanding/contracting operation thereof is not hindered.

Note that, in this embodiment, the gear portion 2*d* is provided in a longitudinal direction (developer conveying direction) of the cylindrical portion 2*k*, but the present invention is not limited thereto. For example, the gear portion 2*d* may be provided on another end side in the longitudinal direction of the developer containing portion 2, in other words, a rearmost side thereof. In this case, the drive gear 300 is set to a position corresponding thereto.

Further, in this embodiment, the gear mechanism is used as a drive linkage mechanism between the drive input portion of the developer replenishing container 1 and the drive portion of the developer replenishing apparatus 201. However, the present invention is not limited thereto. For example, a known coupling mechanism may be used. Specifically, a recessed portion having a non-circular shape may be provided as the drive input portion, and a projecting portion having a shape corresponding to that of the above-mentioned recessed portion may be provided as the drive portion of the developer replenishing apparatus 201 so that a drive linkage is established therebetween.

(Drive Conversion Mechanism)

Next, the drive conversion mechanism (drive conversion portion) of the developer replenishing container 1 is described. Note that, in the case described in this embodiment, a cam mechanism is used as an example of the drive conversion mechanism.

The cam mechanism provided to the developer replenishing container 1 functions as the drive conversion mechanism (drive conversion portion) for converting the rotation drive force for rotating the conveying portion 2*c*, which is received by the gear portion 2*d*, to a force in a direction in which the pump portion 3*a* is reciprocated.

In other words, in the configuration of this embodiment, a single drive input portion (gear portion 2*d*) receives the drive force for rotating the conveying portion 2*c* and reciprocating the pump portion 3*a*, and the rotation drive force that is received by the gear portion 2*d* is converted to reciprocating power on the developer replenishing container 1 side.

This is because the drive input mechanism of the developer replenishing container 1 can be simplified in configuration in comparison with a case where two drive input portions are separately provided in the developer replenishing container 1. Further, the drive is received from the single drive gear of the developer replenishing apparatus 201. This configuration contributes to simplification of the drive mechanism of the developer replenishing apparatus 201.

Figure 8C:
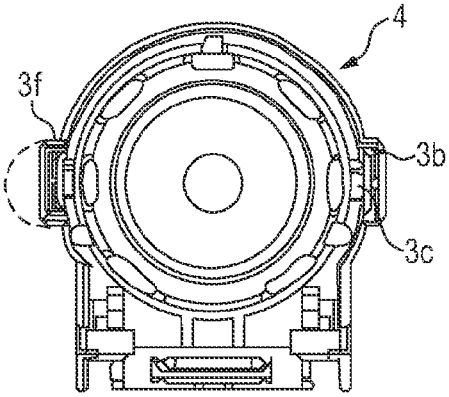
FIG. 8C is a partial view of the pump portion.

Here, FIG. 8A is a partial view of the state where the pump portion 3*a* is maximally expanded at the time of its use, FIG. 8B is a partial view of the state where the pump portion 3*a* is maximally contracted at the time of its use, and FIG. 8C is a partial view of the pump portion. As illustrated in FIGS. 8A and 8B, the reciprocating member 3*b* is used as a member that is interposed to convert the rotation drive force to the reciprocating power of the pump portion 3*a*. Specifically, the drive input portion (gear portion 2*d*) that receives the rotation drive from the drive gear 300, and the cam groove 2*e* that is continuously provided over an entire periphery are rotated. The cam groove 2*e* is described later. A reciprocating member engagement protrusion 3*c* that is a part projecting from the reciprocating member 3*b* is engaged with the cam groove 2*e*. Note that, in this embodiment, as illustrated in FIG. 8C, in order that the reciprocating member 3*b* is not rotated by itself in the rotation direction of the cylindrical portion 2*k* (except movements as large as backlash), the rotation direction of the cylindrical portion 2*k* is restricted by a protective member rotation restricting portion 3*f*. When the rotation direction is restricted in this way, the reciprocating member 3*b* is restricted to reciprocate along the cam groove 2*e* (in the direction X in FIGS. 7A and 7B or the opposite direction). Further, multiple reciprocating member engagement protrusions 3*c* are provided to be engaged with the cam groove 2*e*. Specifically, two reciprocating member engagement protrusions 3*c* are provided at substantially 180° on an inner peripheral surface of the reciprocating member 3*b* so as to face each other.

In this context, the number of the reciprocating member engagement protrusions 3*c* to be arranged is not particularly limited as long as at least one reciprocating member engagement protrusion 3*c* is provided. Note that, a reactive force at the time of the expansion/contraction of the pump portion 3*a* may generate moment, for example, in the drive conversion mechanism, and reciprocation may not be smoothly performed. Thus, it is preferred that the multiple reciprocating member engagement protrusions 3*c* be provided so as not to break the relationship with a shape of the cam groove 2*e* described later.

In other words, in conjunction with the rotation of the cam groove 2*e* by the rotation drive force input from the drive gear 300, the reciprocating member engagement protrusions 3*c* are reciprocated along the cam groove 2*e* in the direction X or the opposite direction. With this, the state where the pump portion 3*a* is expanded (FIG. 8A) and the state where the pump portion 3*a* is contracted (FIG. 8B) are repeated alternately to each other. In this way, the volume of the developer replenishing container 1 can be changed.

Further, in this embodiment, the drive conversion mechanism performs drive conversion so that an amount (per unit time) of the developer that is conveyed to the discharge portion 4*c* along with the rotation of the cylindrical portion 2*k* is larger than an amount (per unit time) of the developer that is discharged to the developer replenishing apparatus 201 through the discharge portion 4*c* by an action of the pump portion.

This is because, when performance of the pump portion 3*a* for discharging the developer is greater than performance of the conveying portion 2*c* for conveying the developer to the discharge portion 4*c*, an amount of the developer left in the discharge portion 4*c* gradually decreases. In other words, the drive conversion is intended to prevent increases in time period required for the replenishment of the developer from the developer replenishing container 1 to the developer replenishing apparatus 201.

In this embodiment, the drive conversion by the drive conversion mechanism causes the pump portion 3*a* to reciprocate multiple times per rotation of the cylindrical portion 2*k*.

(Developer Replenishing Step)

Next, the developer replenishing step by the pump portion 3*a* is described with reference to FIGS. 8A to 8C and FIGS. 9A to 9F.

In the configuration of this embodiment, the rotation drive force is converted to the reciprocating power by the drive conversion mechanism so as to perform, as described later, an intake step (intake operation through the discharge port 4*a*) and an exhaust step (exhaust operation through the discharge port 4*a*) in conjunction with the operation of the pump portion, and an operation stopping step (stopping intake/exhaust through the discharge port 4*a*) in conjunction with stopping of the operation of the pump portion. In the following, the intake step, the exhaust step, and the operation stopping step are sequentially described in detail.

(Intake Step)

First, the intake step (intake operation through the discharge port 4*a*) is described.

The intake operation is performed by switching the state where the pump portion 3*a* is maximally contracted to the state where the pump portion 3*a* is maximally expanded with the drive conversion mechanism (cam mechanism) described above. In other words, along with the intake operation, volumes of parts (pump portion 3*a*, cylindrical portion 2*k*, and flange portion 4) that can contain the developer in the developer replenishing container 1 are increased.

At this time, the inside of the developer replenishing container 1 is substantially sealed except the discharge port 4*a*, and the discharge port 4*a* is substantially closed by the developer T. Thus, along with an increase in volumes of the parts that can contain the developer T in the developer replenishing container 1, an internal pressure of the developer replenishing container 1 decreases.

At this time, the internal pressure of the developer replenishing container 1 is lower than the atmospheric pressure (outside air pressure). Thus, the air on the outside of the developer replenishing container 1 is moved into the developer replenishing container 1 through the discharge port 4*a* by a pressure difference between the inside and the outside of the developer replenishing container 1.

At this time, the developer T located near the discharge port 4*a* can be loosened (fluidized) by the air taken in from the outside of the developer replenishing container 1 through the discharge port 4*a*. Specifically, the air is mixed into the developer T located near the discharge port 4*a* so as to reduce a bulk density. In this way, the developer T can be appropriately fluidized.

Further, at this time, the air is taken into the developer replenishing container 1 through the discharge port 4*a*. Thus, the internal pressure of the developer replenishing container 1 is maintained to be substantially equal to the atmospheric pressure (outside air pressure) irrespective of the increase in volume of the developer replenishing container 1.

In this way, when the developer T is fluidized in advance, the developer T can be smoothly discharged through the discharge port 4*a* without clogging the discharge port 4*a* with the developer T at the time of the exhaust operation described later.

Note that, at the time of performing the intake operation, not only when the pump portion 3*a* is switched from the maximally contracted state to the maximally expanded state but also when the pump portion 3*a* stops halfway between the maximally contracted state and the maximally expanded state, the intake operation is performed as long as the internal pressure of the developer replenishing container 1 is changed. In other words, the intake step corresponds to a state where the reciprocating member engagement protrusion 3*c* is engaged with a cam groove 2*h* illustrated in FIGS. 9A to 9F.

(Exhaust Step)

Next, the exhaust step (exhaust operation through the discharge port 4*a*) is described.

The exhaust operation is performed by switching the state where the pump portion 3*a* is maximally expanded to the state where the pump portion 3*a* is maximally contracted. Specifically, along with the exhaust operation, the volumes of the parts (pump portion 3*a*, cylindrical portion 2*k*, and discharge portion 4*c*) that can contain the developer in the developer replenishing container 1 are decreased. At this time, the inside of the developer replenishing container 1 is substantially sealed except the discharge port 4*a*, and the discharge port 4*a* is substantially closed by the developer T until the developer is discharged. Thus, along with a decrease in volumes of the parts that can contain the developer T in the developer replenishing container 1, the internal pressure of the developer replenishing container 1 increases.

At this time, the internal pressure in the developer replenishing container 1 is higher than the atmospheric pressure (outside air pressure). Thus, the developer T is forced out through the discharge port 4*a* by the pressure difference between the inside and the outside of the developer replenishing container 1. In other words, the developer T is discharged from the developer replenishing container 1 to the developer replenishing apparatus 201.

The air in the developer replenishing container 1 is discharged together with the developer T, and hence the internal pressure of the developer replenishing container 1 decreases.

As described above, in this embodiment, the developer can be efficiently discharged with the single reciprocating-type pump portion 3*a*, and hence a mechanism that is needed to discharge the developer can be simplified.

Note that, at the time of performing the exhaust operation, not only when the pump portion 3*a* is switched from the maximally expanded state to the maximally contracted state but also when the pump portion 3*a* stops halfway between the maximally expanded state and the maximally contracted state, the exhaust operation is performed as long as the internal pressure of the developer replenishing container 1 is changed. In other words, the exhaust step corresponds to a state where the reciprocating member engagement protrusion 3*c* is engaged with a cam groove 2*g* illustrated in FIGS. 9A to 9F.

(Operation Stopping Step)

Next, the operation stopping step in which the pump portion 3*a* is not reciprocated is described.

In the configuration of this embodiment, the control apparatus 600 controls the operation of the drive motor 500 based on detection results from a magnetic sensor 800*c* or the developer sensor 10*d*. In this configuration, an amount of the developer that is discharged from the developer replenishing container 1 directly influences toner concentration, and hence the developer needs to be replenished from the developer replenishing container 1 by an amount required by the image forming apparatus. At this time, in order to stabilize the amount of the developer that is discharged from the developer replenishing container, it is desired that the volumes be changed by a predetermined regular amount.

For example, when the cam groove 2*e* corresponds only to the exhaust step and the intake step, the motor drive is stopped halfway in the exhaust step or the intake step. In this case, also after rotation of the drive motor 500 is stopped, the cylindrical portion 2*k* is inertially rotated. In conjunction therewith, the pump portion 3*a* continues to be reciprocated until the cylindrical portion 2*k* stops. As a result, the exhaust step or the intake step is performed. An amount of the inertial rotation of the cylindrical portion 2*k* depends on a rotation speed of the cylindrical portion 2*k*. Further, the rotation speed of the cylindrical portion 2*k* depends on torque to be applied to the drive motor 500. For this reason, the torque to the motor may change depending on the amount of the developer in the developer replenishing container 1, and the speed of the cylindrical portion 2*k* may change in accordance therewith. Thus, the pump portion 3*a* is difficult to stop regularly at the same position.

In view of the circumstances, in order to stop the pump portion 3*a* regularly at the same position, the cam groove 2*e* needs to be provided with a region in which the pump portion 3*a* is not reciprocated even when the cylindrical portion 2*k* is under the rotation operation. In this embodiment, cam grooves 2*i* illustrated in FIGS. 9A to 9F are provided so as not to reciprocate the pump portion 3*a*. The cam grooves 2*i* are formed along the rotation direction of the cylindrical portion 2*k* into a straight shape so as not to move the reciprocating member 3*b* even when the cylindrical portion 2*k* is rotated. In other words, the operation stopping step corresponds to a state where the reciprocating member engagement protrusion 3*c* is engaged with the cam groove 2*i*.

Further, when the pump portion 3*a* is not reciprocated as described above, the developer is not discharged through the discharge port 4*a* (except developer to fall through the discharge port 4*a*, for example, due to vibration at the time of rotation of the cylindrical portion 2*k*). In other words, the cam grooves 2*i* may be inclined in the rotation axis direction with respect to the rotation direction as long as the exhaust step and the intake step through the discharge port 4*a* are not performed. Further, when the cam grooves 2*i* are inclined, the pump portion 3*a* is allowed to reciprocate by an amount corresponding to the inclination.

(Modification of Setting Condition of Cam Grooves)

Next, a modification of a setting condition of the cam groove 2*e* is described with reference to FIGS. 9A to 9F. First, FIGS. 9A to 9F is a developed view of the cam groove 2*e*. With reference to FIGS. 9A to 9F, that is, the developed view of the drive conversion mechanism, how an operating condition of the pump portion 3*a* is influenced in accordance with changes in shape of the cam groove 2*e* is described.

Here, in FIGS. 9A to 9F, the arrow A indicates the rotation direction of the cylindrical portion 2*k* (moving direction of the cam groove 2*e*), the arrow B indicates an expansion direction of the pump portion 3*a*, and the arrow C indicates a compression direction of the pump portion 3*a*. Further, the cam groove 2*e* includes the cam grooves 2*g* that are used at the time of compressing the pump portion 3*a*, the cam grooves 2*h* that are used at the time of expanding the pump portion 3*a*, and a pump-portion operation stopping portion 2*i* in which the pump portion 3*a* is not reciprocated as describe above. Further, the cam groove 2*g* forms an angle α and the cam groove 2*h* forms an angle β with respect to the rotation direction A of the cylindrical portion 2*k*. The cam grooves have an amplitude K1 in the expansion direction B and the contraction direction C of the pump portion 3*a* (that is, expansion/contraction length of the pump portion 3*a*).

First, the expansion/contraction length K1 of the pump portion 3*a* is described.

For example, when the expansion/contraction length K1 is set to be small, that is, the volume changeable amount of the pump portion 3*a* is reduced, the pressure difference that can be generated with respect to the outside air pressure is reduced in accordance therewith. Thus, a pressure on the developer in the developer replenishing container 1 is reduced. As a result, an amount of the developer that is discharged from the developer replenishing container 1 per cycle of the pump portion 3*a* (that is, expansion and contraction in a single reciprocation of the pump portion 3*a*) is reduced.

Figure 9A:
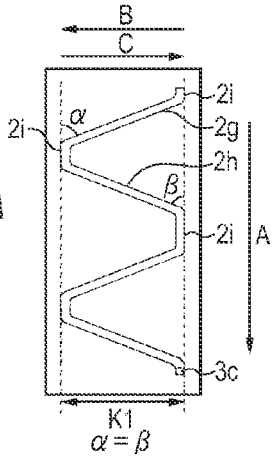
FIG. 9A is a development view illustrating the cam groove shape of the developer replenishing container.
Figure 9B:
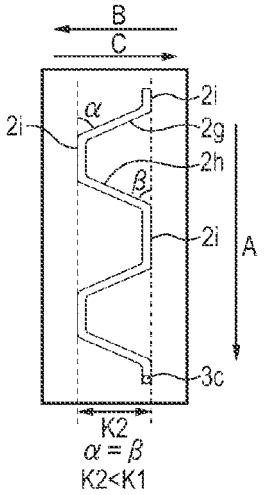
FIGS. 9B, 9C, 9D, 9E, and 9F are each a development view illustrating an example of the cam groove shape of the developer replenishing container.

For this reason, as illustrated in FIG. 9B, when an amplitude K2 of the cam grooves is set to be smaller than the amplitude K1 under a state where the angles α and β are maintained to be constant, an amount of the developer that is discharged by a single reciprocation of the pump portion 3*a* is reduced in comparison with that in the configuration of FIG. 9A. In contrast, when the amplitude K2 is set to be larger than the amplitude K1, a discharge amount of the developer can be increased as a matter of course.

Further, for example, in a case where the angles α and β of the cam grooves are set to be large, when the cylindrical portion 2*k* is rotated at a constant speed, the reciprocating member engagement protrusions 3*c* move by a larger amount in conjunction with a rotation of the developer containing portion 2 over a predetermined time period. As a result, the pump portion 3*a* is expanded and contracted at a higher speed.

Meanwhile, when the reciprocating member engagement protrusions 3*c* move along the cam grooves 2*g* and the cam grooves 2*h*, resistance to be received from the cam grooves 2*g* and the cam grooves 2*h* becomes higher. As a result, higher torque is needed to rotate the cylindrical portion 2*k*.

Figure 9C:
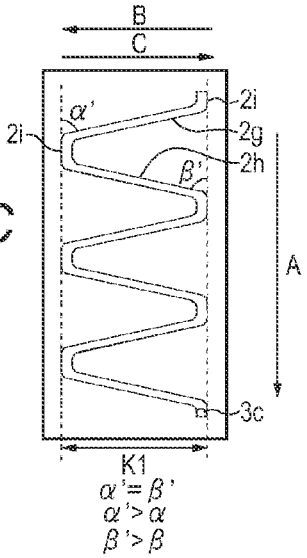
Figure 9D:
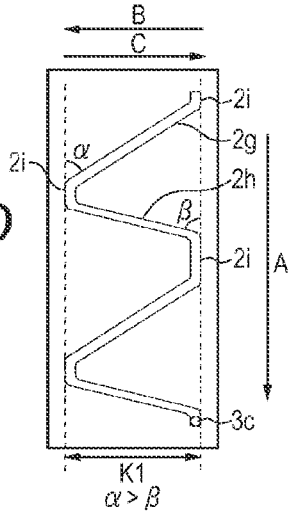

For this reason, as illustrated in FIG. 9C, when an angle α' of the cam groove 2*g* and an angle β' of the cam groove 2*h* are set to be respectively larger than the angle α and the angle β under a state where the expansion/contraction length K1 is maintained to be constant, the pump portion 3*a* can be expanded and contracted at a speed higher than that in the configuration of FIG. 9A. As a result, the pump portion 3*a* can be expanded and contracted a larger number of times per rotation of the cylindrical portion 2*k*. Further, the air enters the inside of the developer replenishing container 1 at a higher flow rate through the discharge port 4*a*. Thus, an effect of loosening the developer left around the discharge port 4*a* is enhanced.

In contrast, when the angle α' and the angle β' are set to be respectively smaller than the angle α and the angle β, rotation torque of the cylindrical portion 2*k* can be reduced. Further, for example, in a case of using a developer having high fluidity, the developer left around the discharge port 4*a* is more likely to be blown off by the air that enters through the discharge port 4*a* at the time when the pump portion 3*a* is expanded. As a result, the developer cannot be sufficiently pooled in the discharge portion 4*c*, with the result that the discharge amount of the developer may be reduced. In this case, when the expanding speed of the pump portion 3*a* is reduced through the setting of this embodiment, the developer is suppressed from being blown off. In this way, the discharge performance can be enhanced.

Further, when the angle α is set to be smaller than the angle β, the expanding speed of the pump portion 3*a* can be set to be higher than the compression speed thereof. In contrast, when the angle α is set to be larger than the angle β as in the cam groove 2*e* illustrated in FIG. 9D, the expanding speed of the pump portion 3*a* can be set to be lower than the compression speed thereof.

With this, for example, under a state where the developer in the developer replenishing container 1 has a high density, a force of operating the pump portion 3*a* is greater at the time of compressing the pump portion 3*a* than at the time of expanding the pump portion 3*a*. As a result, the rotation torque of the cylindrical portion 2*k* at the time of compressing the pump portion 3*a* is liable to become higher.

Figure 9E:
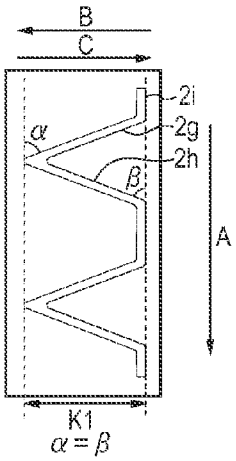

Note that, as illustrated in FIG. 9E, the cam groove 2*e* may be configured so that the reciprocating member engagement protrusions 3*c* pass through the cam groove 2*g* immediately after passing through the cam groove 2*h*. In this configuration, the pump portion 3*a* is switched to the exhaust operation immediately after performing the intake operation. The operation stopping process under the state where the pump portion 3*a* is expanded is omitted. Thus, during a time period corresponding to the omitted operation stopping, the decompressed state in the developer replenishing container 1 cannot be maintained, and hence the effect of loosening the developer T is reduced. However, by an amount corresponding to the omission of the operation stopping process, the intake/exhaust step can be performed a larger number of times per rotation of the cylindrical portion 2*k*. As a result, a larger amount of the developer T can be discharged.

Figure 9F:
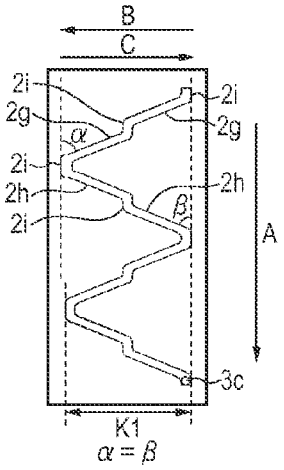

Alternatively, as illustrated in FIG. 9F, the operation stopping step may be performed not only under the state where the pump portion 3*a* is maximally contracted or the state where the pump portion 3*a* is maximally expanded but also halfway in the exhaust step or the intake step. With this, the volume changeable amount can be set as needed, and the pressure in the developer replenishing container 1 can be adjusted.

As described above, by changing the shape of the cam groove 2*e* as illustrated in FIGS. 9A to 9F, the discharge performance of the developer replenishing container 1 can be adjusted. Thus, a developer amount that is required by the developer replenishing apparatus 201 and physical properties of the developer to be used can be appropriately set.

As described above, in the configuration of this embodiment, the single drive input portion (gear portion 2*d*) receives the drive force for rotating the conveying portion (helical projecting portion 2*c*) and the drive force for reciprocating the pump portion 3*a*. Thus, the drive input mechanism of the developer replenishing container can be simplified in configuration. Further, the drive force is applied to the developer replenishing container through intermediation of the single drive mechanism (drive gear 300) provided to the developer replenishing apparatus. This configuration contributes to simplification of the drive mechanism of the developer replenishing apparatus.

Further, according to the configuration of this embodiment, the rotation drive force for rotating the conveying portion, which is received from the developer replenishing apparatus, is subjected to drive conversion with the drive conversion mechanism of the developer replenishing container. With this configuration, the pump portion 3*a* can be appropriately reciprocated.

The basic configuration and features of the present invention have been described above. Now, the present invention is specifically described based on Examples. However, the present invention is by no means limited thereto.

[Developer Production Example]

[Production Example of Binder Resin 1]

76.9 Parts by mass (0.167 part by mole) of polyoxypropylene(2.2)-2,2-bis(4-hydroxyphenyl)propane, 24.1 parts by mass (0.145 part by mole) of terephthalic acid, and 0.5 part by mass of titanium tetrabutoxide were loaded into a 4-liter, four-necked flask made of glass. A temperature gauge, a stirring rod, a condenser, and a nitrogen introducing tube were attached to the flask, and the flask was set in a mantle heater. Next, air in the flask was replaced with a nitrogen gas. After that, a temperature in the flask was gradually increased while the mixture was stirred. The mixture was subjected to a reaction for 4 hours while being stirred at a temperature of 200° C. (first reaction step). After that, 2.0 parts by mass (0.010 part by mole) of trimellitic anhydride were added to the resultant, and the mixture was subjected to a reaction at 180° C. for 1 hour (second reaction step) to provide a binder resin 1.

The binder resin 1 had an acid value of 10 mgKOH/g and a hydroxyl value of 65 mgKOH/g. In addition, its molecular weights measured by GPC (Gel Permeation Chromatography) were as follows: a weight-average molecular weight (Mw) of 8,000, a number-average molecular weight (Mn) of 3,500, and a peak molecular weight (Mp) of 5,700. The resin had a softening point of 90° C.

[Production Example of Binder Resin 2]

71.3 Parts by mass (0.155 part by mole) of polyoxypropylene(2.2)-2,2-bis(4-hydroxyphenyl)propane, 24.1 parts by mass (0.145 part by mole) of terephthalic acid, and 0.6 part by mass of titanium tetrabutoxide were loaded into a 4-liter, four-necked flask made of glass. A temperature gauge, a stirring rod, a condenser, and a nitrogen introducing tube were attached to the flask, and the flask was set in a mantle heater. Next, air in the flask was replaced with a nitrogen gas. After that, a temperature in the flask was gradually increased while the mixture was stirred. The mixture was subjected to a reaction for 2 hours while being stirred at a temperature of 200° C. (first reaction step). After that, 5.8 parts by mass (0.030 part by mole) of trimellitic anhydride were added to the resultant, and the mixture was subjected to a reaction at 180° C. for 10 hours (second reaction step) to provide a binder resin 2.

The binder resin 2 had an acid value of 15 mgKOH/g and a hydroxyl value of 7 mgKOH/g. In addition, its molecular weights measured by GPC were as follows: a weight-average molecular weight (Mw) of 200,000, a number-average molecular weight (Mn) of 5,000, a peak molecular weight (Mp) of 10,000, and a softening point of 130° C.

[Polymer Production Example 1]

Low-density polyethylene (Mw: 1,400, Mn: 850, peak temperature of the highest endothermic peak measured with a DSC: 100° C.) 18 parts by mass Styrene 66 parts by mass n-Butyl acrylate 13.5 parts by mass Acrylonitrile 2.5 parts by mass The materials were loaded into an autoclave and air in the system was replaced with $N_2$. After that, a temperature in the system was increased and kept at 180° C. while the mixture was stirred. 50 Parts by mass of a 2-mass % xylene solution of t-butyl hydroperoxide were continuously dropped to the system over 5 hours, and the mixture was cooled, followed by the separation and removal of the solvent. Thus, a polymer A in which a vinyl resin component reacted with the low-density polyethylene was obtained. The measurement of the molecular weights of the polymer A showed that the polymer had a weight-average molecular weight (Mw) of 7,100 and a number-average molecular weight (Mn) of 3,000. Further, a dispersion obtained by dispersing the polymer in a 45-vol % aqueous solution of methanol had a transmission at a wavelength of 600 nm measured at a temperature of 25° C. of 69%.

[Polymer Production Example 2]

Low-density polyethylene (Mw: 1,300, Mn: 800, peak temperature of the highest endothermic peak measured with a DSC: 95° C.) 20 parts by mass o-Methyl styrene 65 parts by mass n-Butyl acrylate 11 parts by mass Meth acrylonitrile 4.0 parts by mass The materials were loaded into an autoclave and air in the system was replaced with $N_2$. After that, a temperature in the system was increased and kept at 170° C. while the mixture was stirred. 50 Parts by mass of a 2-mass % xylene solution of t-butyl hydroperoxide were continuously dropped to the system over 5 hours, and the mixture was cooled, followed by the separation and removal of the solvent. Thus, a polymer B in which a vinyl resin component reacted with the low-density polyethylene was obtained. The measurement of the molecular weights of the polymer B showed that the polymer had a weight-average molecular weight (Mw) of 6,900 and a number-average molecular weight (Mn) of 2,900. Further, a dispersion obtained by dispersing the polymer in a 45-vol % aqueous solution of methanol had a transmission at a wavelength of 600 nm measured at a temperature of 25° C. of 63%.

[Silica Fine Particle Production Example 1]

In the production of silica fine particles, a hydrocarbon-oxygen mixed burner of a double tube structure capable of forming an inner flame and an outer flame was used as a combustion furnace. A two fluid nozzle for slurry injection is set at the central portion of the burner and a silicon compound as a raw material is introduced. A combustible gas formed of a hydrocarbon and oxygen is injected from the surroundings of the two fluid nozzle to form an inner flame and outer flame as a reducing atmosphere. The atmosphere, a temperature, the length of each flame, and the like are adjusted by controlling the amounts and flow rates of the combustible gas and oxygen. Silica fine particles are formed from the silicon compound in the flames, and are fused together until a desired particle diameter is obtained. After that, the particles are cooled and then collected with a bag filter or the like, whereby the silica fine particles are obtained.

Silica fine particles were produced by using hexamethylcyclotrisiloxane as the silicon compound as a raw material. 100 Parts by mass of the resultant silica fine particles were subjected to surface treatment with 4 mass % of hexamethyldisilazane to provide silica fine particles 1. Table 1-1 shows the number-average particle diameter of primary particles of the resultant silica fine particles ("Particle diameter" in Tables).

[Silica Fine Particle Production Examples 2 to 8]

Silica fine particles 2 to 8 were produced by the same approach as that of the silica fine particles 1 except that the average particle diameter of a silica raw material was changed so that such a number-average particle diameter of primary particles as shown in Table 1-1 and Table 1-2 were obtained. Table 1-1 and Table 1-2 show their number-average particle diameters of primary particles.

| <Toner Production Example 1> | |
|---|---|
| Binder resin 1 | 50.0 parts by mass |
| Binder resin 2 | 50.0 parts by mass |
| Fischer-Tropsch wax (peak temperature of the highest endothermic peak measured with DSC: 78° C.) | 6.0 parts by mass |
| C.I. Pigment Blue 15:3 | 5.0 parts by mass |
| Aluminum 3,5-di-t-butylsalicylate compound | 0.5 part by mass |
| Polymer A | 5.0 parts by mass |

Raw materials shown in the formulation were mixed with a Henschel mixer (FM-75 Type manufactured by Mitsui Mining CO., LTD.) at a number of rotations of 20 $s^{-1}$ for a time of rotation of 5 min. After that, the mixture was kneaded with a biaxial kneader (PCM-30 Type manufactured by Ikegai Corp.) set at a temperature of 125° C. The resultant kneaded product was cooled and coarsely pulverized with a hammer mill to 1 mm or less to provide a coarsely pulverized product. The resultant coarsely pulverized product was finely pulverized with a mechanical pulverizer (T-250 manufactured by Turbo Kogyo Co., Ltd.). Further, the resultant was classified with a rotary classifier (200TSP manufactured by Hosokawa Micron Corporation) to provide toner particles. The rotary classifier (200TSP manufactured by Hosokawa Micron Corporation) was operated under the following condition: the classification was performed at a number of rotations of a classification rotor of 50.0 $s^{-1}$. The resultant toner particles had a weight-average particle diameter (D4) of 5.7 μm.

4.5 Parts by mass of the silica fine particles 1 and 0.5 part by mass of titanium oxide fine particles having a BET specific surface area of 180 $m^2/g$ whose surfaces had been treated with 16 mass % of isobutyltrimethoxysilane were added to 100 parts by mass of the resultant toner particles, and the particles were mixed with a Henschel mixer (FM-75 Type manufactured by Mitsui MiningMitsui Mining CO., LTD.) at a number of rotations of 30 $s^{-1}$ for a time of rotation of 10 min, followed by heat treatment with the surface treatment apparatus illustrated in FIG. 1. The apparatus was operated under the conditions of a feeding amount of 5 kg/hr, a hot air temperature C of 220° C., a hot air flow rate of 6 $m^3$/min, a cold air temperature E of 5° C., a cold air flow rate of 4 $m^3$/min, a cold air absolute moisture content of 3 $g/m^3$, a blower air quantity of 20 $m^3$/min, and an injection air flow rate of 1 $m^3$/min. The resultant treated toner particles had an average circularity of 0.963 and a weight-average particle diameter (D4) of 6.2 μm.

0.5 Part of strontium titanate fine particles having a BET specific surface area of 10 $m^2/g$ was added to 100 parts by mass of the resultant treated toner particles, and the particles were mixed with a Henschel mixer (FM-75 Type manufactured by Mitsui Mining CO., LTD.) at a number of rotations of 30 $s^{-1}$ for a time of rotation of 10 min to provide a toner 1. Table 1-1 shows the physical properties of the resultant toner (i.e. a coverage rate of surfaces of the toner particles with the silica fine particles ("Coverage rate" in Tables), a uniaxial collapse stress at a time of a maximum consolidation stress of 10.0 kPa ("Uniaxial collapse stress" in Tables), and a sticking ratio of the silica fine particles ("Sticking ratio" in Tables)).

<Toner Production Examples 2 to 13>

Toners 2 to 13 were each obtained in the same manner as in Toner Production Example 1 except that: the wax, the polymer, the silica fine particles, and the added number of parts of each of them were changed as shown in Table 1-1 and Table 1-2; and the hot air temperature was treated as shown in Table 1-1 and Table 1-2. Table 1-1 and Table 1-2 show the physical properties of the resultant toners.

| <Toner Production Example 14> | |
|---|---|
| Binder resin 1 | 50.0 parts by mass |
| Binder resin 2 | 50.0 parts by mass |
| Fischer-Tropsch wax (peak temperature of the highest endothermic peak measured with DSC: 78° C.) | 4.0 parts by mass |
| C.I. Pigment Blue 15:3 | 5.0 parts by mass |
| Aluminum 3,5-di-t-butylsalicylate compound | 0.5 part by mass |
| Polymer B | 4.0 parts by mass |

The raw materials were mixed with a Henschel mixer (FM-75 Type manufactured by Mitsui Mining CO., LTD.) at a number of rotations of 20 $s^{-1}$ for a time of rotation of 5 min. After that, the mixture was kneaded with a biaxial kneader (PCM-30 Type manufactured by Ikegai Corp.) set at a temperature of 125° C. The resultant kneaded product was cooled and coarsely pulverized with a hammer mill to 1 mm or less to provide a coarsely pulverized product. The resultant coarsely pulverized product was finely pulverized with a mechanical pulverizer (T-250 manufactured by Turbo Kogyo Co., Ltd.). Further, the resultant was classified with a rotary classifier (200TSP manufactured by Hosokawa Micron Corporation) to provide toner particles. The rotary classifier (200TSP manufactured by Hosokawa Micron Corporation) was operated under the following condition: the classification was performed at a number of rotations of a classification rotor of 50.0 $s^{-1}$. The resultant toner particles had a weight-average particle diameter (D4) of 5.7 μm.

2.5 Parts by mass of the silica fine particles 1 were added to 100 parts by mass of the resultant toner particles, and the particles were mixed with a Henschel mixer (FM-75 Type manufactured by Mitsui Mining CO., LTD.) at a number of rotations of 30 $s^{-1}$ for a time of rotation of 60 min to provide a toner 14. Table 1-2 shows the physical properties of the resultant toner.

<Toner Production Examples 15 and 16>

Toners 15 and 16 were each obtained in the same manner as in Toner Production Example 13 except that the wax, the polymer, the silica fine particles, and the added number of parts of each of them were changed as shown in Table 1-2. Table 1-2 shows the physical properties of the resultant toners.

(Magnetic Carrier Production Example 1)

Water was added to 100 parts by mass of $Fe_2O_3$ and the mixture was pulverized with a ball mill for 15 min to produce a magnetic core having an average particle diameter of 55 μm.

Next, a mixed liquid of 1.0 part by mass of a straight silicone resin (manufactured by Shin-Etsu Chemical Co., Ltd.: KR271), 0.5 part by mass of γ-aminopropyltriethoxysilane, and 98.5 parts by mass of toluene was added to 100 parts by mass of the magnetic core, and the solvent was removed by drying the contents under reduced pressure at 70° C. for 5 hours while stirring and mixing the contents with a solution decompression kneader. After that, the residue was subjected to baking treatment at 140° C. for 2 hours and sieved with a sieve shaker (300MM-Type, TSUTSUI SCIENTIFIC INSTRUMENTS CO., LTD.: 75-μm aperture) to provide a magnetic carrier.

Example 1

The toner 1 and the magnetic carrier were mixed with a V-type mixer (V-10 Type: TOKUJU CORPORATION) under the conditions of 0.5 $s^{-1}$ and a time of rotation of 5 min so that the amount of the toner 1 became 10.0 parts by mass with respect to 1.0 part by mass of the carrier. Thus, a developer 1 was prepared. An evaluation for dischargeability from a developer replenishing cartridge was performed with the resultant developer 1 by the following method.

(Evaluation 1) Test for Dischargeability from Consolidated State

Used as the developer replenishing apparatus of the present invention was the developer replenishing portion of a full-color copying machine "image RUNNER ADVANCE C5255" manufactured by Canon Inc. reconstructed so that a developer replenishing container A illustrated in FIG. 6 of the present invention could be mounted. In addition, a pattern illustrated in FIG. 9A was adopted as the cam groove pattern of the developer replenishing container A, and a pump stroke and a discharge port diameter ϕ were set to 6.0 mm and 3.0 mm, respectively.

700 Grams of the developer 1 were charged into the developer replenishing container A, and tapping was performed at an amplitude of 10 cm 30,000 times in a state where its discharge portion was directed downward. Thus, the consolidated state of the developer was formed.

After that, the developer replenishing cartridge was mounted onto the developer replenishing apparatus, the number of rotations of the developer replenishing container was set to 0.5 $s^{-1}$, the discharge amount of the developer was measured every second, and an average discharge amount and the standard deviation of the discharge amounts for the respective seconds were calculated. In addition, after the completion of the discharge of 550 g of the developer, the tapping was performed again. After that, the same discharge amount measurement was performed, and the developer replenishing cartridge was evaluated for its discharge accuracy at each of the initial stage and later stage of its use.

Table 2 shows the results of the evaluation.

(Evaluation criteria) Standard deviation of developer discharge amounts for respective seconds A: 0.10 or less Extremely excellent B: 0.11 or more and 0.20 or less Good C: 0.21 or more and 0.30 or less Normal D: 0.31 or more Poor (Evaluation 2) Test for Dischargeability in Environment Fluctuating State An evaluation for the discharge of 200 g of the developer was performed with the developer replenishing cartridge under a 40° C./95% RH environment. After that, the temperature and humidity of the evaluation environment were changed to 10° C. and 10% RH, respectively, the same discharge evaluation was performed, and an average discharge amount and a standard deviation were similarly calculated. Table 2 shows the results of the evaluations.

(Evaluation Criteria) Standard Deviation of Developer Discharge Amounts for Respective Seconds A: 0.10 or less Extremely excellent B: 0.11 or more and 0.20 or less Good C: 0.21 or more and 0.30 or less Normal D: 0.31 or more Poor

Examples 2 to 19

Developers 2 to 19 were each produced in the same manner as in Example 1 except that the toner and the toner/carrier ratio were changed as shown in Table 1-1 and Table 1-2, and the developers were each evaluated in the same manner as in Example 1. Table 2 shows the results of the evaluations.

Example 20

The toner 15 was used as a developer without being mixed with the carrier. Evaluations were performed with the developer in the same manner as in Example 1. Table 2 shows the results of the evaluations.

Comparative Example 1

Evaluations were performed in the same manner as in Example 1 with a developer replenishing container B and replenishing apparatus of a full-color copying machine "image RUNNER ADVANCE C5255" manufactured by Canon Inc., and with the developer 15.

Figure 10:
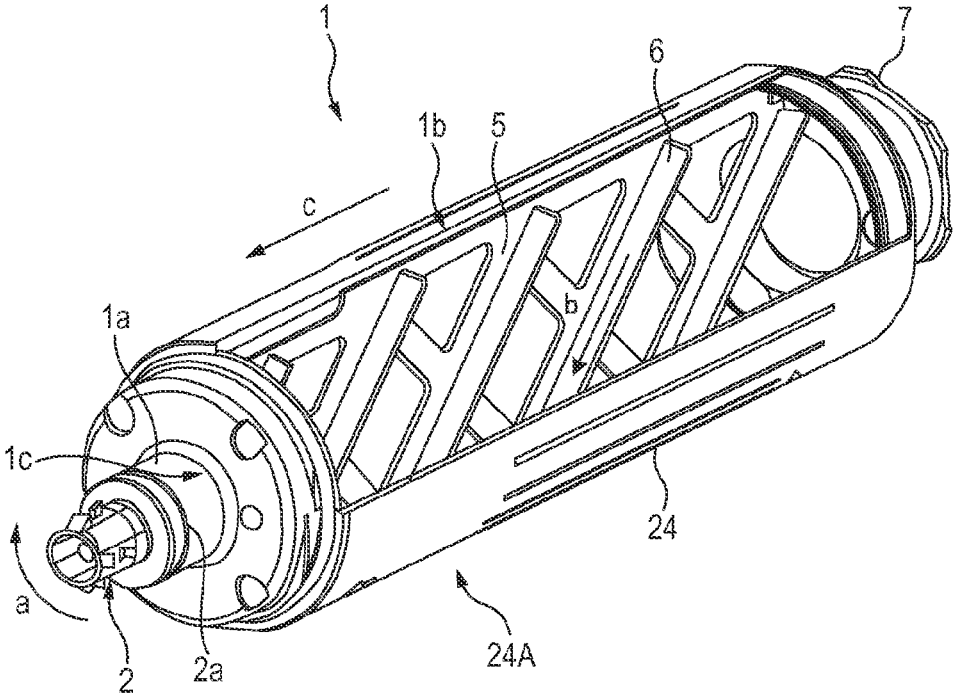
FIG. 10 is a perspective view of a developer replenishing container B.

FIG. 10 is a perspective view of the developer replenishing container B of this example. As illustrated in FIG. 10, the developer replenishing container 1 includes a large diameter portion 1*b* and a small diameter portion 1*c*, and includes a container main body 24A formed into a substantially cylindrical shape. The container main body 24A constitutes: a developer containing portion 24 provided with an opening portion 1*a* at substantially the central portion on one end of the small diameter portion 1*c*; and a flange 7 provided at the other end portion of the developer containing portion 24. In addition, a conveying member 5 (hereinafter referred to as "baffle member") for conveying the developer is provided in the developer containing portion 24, and a sealing member 2 for sealing the opening portion 1*a* is set in the opening portion 1*a*.

As described above, the container main body 24A, i.e., the developer replenishing container B has a substantially cylindrical shape, is set in the main body of the apparatus in a substantially horizontal manner and while being rotatably held, and is configured to rotate by receiving rotary drive from the main body of the apparatus. In addition, as described in the foregoing, the baffle member 5 of a plate-like shape is provided in the developer containing portion 24 of the developer replenishing container 1. The surface of the baffle member 5 is provided with multiple inclined protrusions 6 inclined with respect to the rotation axis line direction of the developer replenishing container B, and one end of each of the inclined protrusions 6 reaches the small diameter portion 1*c*. In the configuration, the developer is finally discharged from the inclined protrusions 6 through the opening portion 1*a*.

The principle on which the developer is discharged is as described below. For example, in FIG. 10, the developer lifted by the baffle member 5 as a result of the rotation of the developer replenishing container B in a direction a slides down on the inclined protrusions 6 in a direction b, and is conveyed by the inclined protrusions 6 to the opening portion 1*a* of the developer replenishing container B in a direction c. The operation is repeated to sequentially stir and convey the developer in the developer replenishing container 1, whereby the developer is discharged from the opening portion 1*a*.

Table 2 shows the results of the evaluation.

| | | | | WAX | | Polymer | | Silica particles | | |
|---|---|---|---|---|---|---|---|---|---|---|
| | Developer replenishing container | Developer No. | Toner No. | Kind | Addition amount (part(s) by mass) | Kind | Addition amount (part(s) by mass) | Kind | Particle diameter (nm) | Addition amount (part(s) by mass) |
| Example 1 | Container A | Developer 1 | Toner 1 | Fisch-Tropsch (78° C.) | 6.0 | Polymer A | 5.0 | Silica fine particles 1 | 110 | 4.5 |
| Example 2 | Container A | Developer 2 | Toner 2 | Fisch-Tropsch (78° C.) | 6.0 | Polymer A | 5.0 | Silica fine particles 2 | 70 | 4.0 |
| Example 3 | Container A | Developer 3 | Toner 3 | Fisch-Tropsch (78° C.) | 6.0 | Polymer A | 5.0 | Silica fine particles 3 | 250 | 5.0 |
| Example 4 | Container A | Developer 4 | Toner 4 | Fisch-Tropsch (78° C.) | 6.0 | Polymer A | 5.0 | Silica fine particles 3 | 250 | 3.5 |
| Example 5 | Container A | Developer 5 | Toner 5 | Fisch-Tropsch (78° C.) | 6.0 | Polymer A | 5.0 | Silica fine particles 2 | 70 | 7.0 |
| Example 6 | Container A | Developer 6 | Toner 6 | Fisch-Tropsch (78° C.) | 6.0 | Polymer A | 5.0 | Silica fine particles 2 | 70 | 3.5 |
| Example 7 | Container A | Developer 7 | Toner 7 | Fisch-Tropsch (78° C.) | 6.0 | Polymer A | 5.0 | Silica fine particles 2 | 70 | 3.5 |
| Example 8 | Container A | Developer 8 | Toner 8 | Fisch-Tropsch (78° C.) | 6.0 | Polymer A | 5.0 | Silica fine particles 4 | 65 | 3.0 |
| Example 9 | Container A | Developer 9 | Toner 9 | Fisch-Tropsch (78° C.) | 6.0 | Polymer A | 5.0 | Silica fine particles 5 | 290 | 5.5 |
| Example 10 | Container A | Developer 10 | Toner 10 | Fisch-Tropsch (78° C.) | 4.0 | Polymer A | 4.0 | Silica fine particles 5 | 290 | 3.5 |

| | Hot air treatment | Amount of toner with respect to 1 part of carrier (part(s)) | Coverage rate (%) | Uniaxial Collapse stress (kPa) | Sticking ratio (%) |
|---|---|---|---|---|---|
| Example 1 | 220° C. | 10.0 | 32% | 3.0 | 92% |
| Example 2 | 220° C. | 10.0 | 35% | 2.9 | 94% |
| Example 3 | 220° C. | 10.0 | 28% | 3.1 | 89% |
| Example 4 | 220° C. | 10.0 | 22% | 3.2 | 90% |
| Example 5 | 220° C. | 10.0 | 60% | 2.9 | 91% |
| Example 6 | 220° C. | 10.0 | 22% | 2.7 | 90% |
| Example 7 | 240° C. | 10.0 | 23% | 3.3 | 91% |
| Example 8 | 200° C. | 10.0 | 21% | 2.7 | 90% |
| Example 9 | 220° C. | 10.0 | 24% | 2.8 | 88% |
| Example 10 | 180° C. | 10.0 | 22% | 2.5 | 87% |

TABLE 1-2

| | | | | WAX | | Polymer | | Silica particles | | | | | | | |
|---|---|---|---|---|---|---|---|---|---|---|---|---|---|---|---|
| | Developer replenishing container | Developer No. | Toner No. | Kind | Addition amount (part(s) by mass) | Kind | Addition amount (part(s) by mass) | Kind | Particle diameter (nm) | Addition amount (part(s) by mass) | Hot air treatment | Amount of toner with respect to 1 part of carrier (part(s)) | Coverage rate (%) | Uniaxial collapse stress (kPa) | Sticking ratio (%) |
| Example 11 | Container A | Developer 11 | Toner 11 | Fischer-Tropsch (78° C.) | 8.0 | Polymer A | 6.0 | Silica fine particles 5 | 290 | 3.5 | 240° C. | 10.0 | 22% | 3.5 | 90% |
| Example 12 | Container A | Developer 12 | Toner 12 | Fischer-Tropsch (78° C.) | 4.0 | Polymer B | 4.0 | Silica fine particles 5 | 290 | 3.5 | 160° C. | 10.0 | 22% | 2.5 | 85% |
| Example 13 | Container A | Developer 13 | Toner 13 | Fischer-Tropsch (78° C.) | 4.0 | Polymer B | 4.0 | Silica fine particles 5 | 290 | 3.0 | 150° C. | 10.0 | 21% | 2.5 | 81% |
| Example 14 | Container A | Developer 14 | Toner 12 | Fischer-Tropsch (78° C.) | 4.0 | Polymer B | 4.0 | Silica fine particles 5 | 290 | 2.5 | — | 10.0 | 18% | 2.6 | 67% |
| Example 15 | Container A | Developer 15 | Toner 12 | Fischer-Tropsch (78° C.) | 4.0 | Polymer B | 4.0 | Silica fine particles 5 | 290 | 2.0 | — | 10.0 | 16% | 2.6 | 69% |
| Example 16 | Container A | Developer 16 | Toner 12 | Fischer-Tropsch (78° C.) | 4.0 | Polymer B | 4.0 | Silica fine particles 6 | 65 | 10.0 | — | 14.0 | 92% | 2.5 | 72% |
| Example 17 | Container A | Developer 17 | Toner 15 | Fischer-Tropsch (78° C.) | 4.0 | Polymer B | 4.0 | Silica fine particles 5 | 290 | 2.0 | — | 4.0 | 16% | 2.6 | 77% |
| Example 18 | Container A | Developer 18 | Toner 15 | Fischer-Tropsch (78° C.) | 4.0 | Polymer B | 4.0 | Silica fine particles 5 | 290 | 2.0 | — | 28.0 | 16% | 2.6 | 77% |
| Example 19 | Container A | Developer 19 | Toner 15 | Fischer-Tropsch (78° C.) | 4.0 | Polymer B | 4.0 | Silica fine particles 5 | 290 | 2.0 | — | 35.0 | 16% | 2.6 | 77% |
| Example 20 | Container A | Developer 20 | Toner 15 | Fischer-Tropsch (78° C.) | 4.0 | Polymer B | 4.0 | Silica fine particles 5 | 290 | 2.0 | — | — | 16% | 2.6 | 77% |
| Comparative Example 20 | Container B | Developer 15 | Toner 15 | Fischer-Tropsch (78° C.) | 4.0 | Polymer B | 4.0 | Silica fine particles 5 | 290 | 2.0 | — | 10.0 | 16% | 2.6 | 69% |

TABLE 2

| | Developer | | | Test for discharge ability from consolidated state | | | | | |
|---|---|---|---|---|---|---|---|---|---|
| | | | | Initial stage | | | Later stage | | |
| | | | | Average discharge | Discharge amount | | Average Discharge | Discharge amount | |
| | replenshing Container | Developer No. | Toner No. | amount (g/sec) | Standard deviation | Evaluation | amount (g/sec) | Standard deviation | Evaluation |
| Example 1 | Container A | Developer 1 | Toner 1 | 2.3 | 0.05 | A | 2.3 | 0.04 | A |
| Example 2 | Container A | Developer 2 | Toner 2 | 2.5 | 0.07 | A | 2.4 | 0.06 | A |
| Example 3 | Container A | Developer 3 | Toner 3 | 2.4 | 0.06 | A | 2.3 | 0.06 | A |
| Example 4 | Container A | Developer 4 | Toner 4 | 2.5 | 0.09 | A | 2.3 | 0.13 | B |
| Example 5 | Container A | Developer 5 | Toner 5 | 2.6 | 0.09 | A | 2.1 | 0.08 | A |
| Example 6 | Container A | Developer 6 | Toner 6 | 2.6 | 0.08 | A | 2.4 | 0.14 | B |
| Example 7 | Container A | Developer 7 | Toner 7 | 2.6 | 0.12 | B | 2.3 | 0.08 | A |
| Example 8 | Container A | Developer 8 | Toner 8 | 2.6 | 0.13 | B | 2.2 | 0.15 | B |
| Example 9 | Container A | Developer 9 | Toner 9 | 2.9 | 0.12 | B | 2.1 | 0.08 | A |
| Example 10 | Container A | Developer 10 | Toner 10 | 2.8 | 0.14 | B | 2.0 | 0.15 | B |
| Example 11 | Container A | Developer 11 | Toner 11 | 2.8 | 0.14 | B | 2.3 | 0.09 | A |

TABLE 2-continued

| | | | | | | | | | |
|---|---|---|---|---|---|---|---|---|---|
| Example 12 | Container A | Developer 12 | Toner 12 | 2.9 | 0.15 | B | 2.1 | 0.16 | B |
| Example 13 | Container A | Developer 13 | Toner 13 | 3.3 | 0.15 | B | 2.1 | 0.17 | B |
| Example 14 | Container A | Developer 14 | Toner 14 | 3.2 | 0.16 | B | 1.9 | 0.16 | B |
| Example 15 | Container A | Developer 15 | Toner 15 | 3.1 | 0.17 | B | 2.0 | 0.21 | C |
| Example 16 | Container A | Developer 16 | Toner 16 | 3.2 | 0.18 | B | 1.8 | 0.22 | C |
| Example 17 | Container A | Developer 17 | Toner 15 | 3.2 | 0.23 | C | 2.0 | 0.23 | C |
| Example 18 | Container A | Developer 18 | Toner 15 | 3.1 | 0.17 | B | 2.0 | 0.24 | C |
| Example 19 | Container A | Developer 19 | Toner 15 | 3.3 | 0.25 | C | 1.9 | 0.23 | C |
| Example 20 | Container A | Container 20 | Toner 15 | 3.5 | 0.26 | C | 1.9 | 0.24 | C |
| Comparative Example 1 | Container B | Developer 15 | Toner 15 | 4.2 | 0.33 | D | 1.6 | 0.35 | D |

| | Test for discharge ability under environmental fluctuation | | | | | |
|---|---|---|---|---|---|---|
| | 40° C./95% RH | | | 10° C./10% RH | | |
| | Average discharge amount (g/sec) | Discharge amount Standard deviation | Discharge amount Evaluation | Average discharge amount (g/sec) | Discharge amount Standard deviation | Discharge amount Evaluation |
| Example 1 | 2.3 | 0.06 | A | 2.3 | 0.08 | A |
| Example 2 | 2.3 | 0.08 | A | 2.4 | 0.09 | A |
| Example 3 | 2.2 | 0.13 | B | 2.5 | 0.09 | A |
| Example 4 | 2.4 | 0.09 | A | 2.6 | 0.09 | A |
| Example 5 | 2.2 | 0.08 | A | 2.5 | 0.13 | B |
| Example 6 | 2.3 | 0.09 | A | 2.5 | 0.14 | B |
| Example 7 | 2.2 | 0.08 | A | 2.6 | 0.15 | B |
| Example 8 | 2.2 | 0.08 | A | 2.7 | 0.14 | B |
| Example 9 | 2 | 0.15 | B | 2.8 | 0.15 | B |
| Example 10 | 2.1 | 0.09 | A | 2.8 | 0.09 | A |
| Example 11 | 2.2 | 0.09 | A | 2.7 | 0.16 | B |
| Example 12 | 2 | 0.16 | B | 2.9 | 0.17 | B |
| Example 13 | 2 | 0.18 | B | 3.0 | 0.16 | B |
| Example 14 | 2 | 0.09 | A | 3.1 | 0.22 | C |
| Example 15 | 1.9 | 0.19 | B | 3.0 | 0.23 | C |
| Example 16 | 1.8 | 0.18 | B | 3.2 | 0.22 | C |
| Example 17 | 1.9 | 0.18 | B | 3.3 | 0.25 | C |
| Example 18 | 1.9 | 0.21 | C | 3.2 | 0.26 | C |
| Example 19 | 1.9 | 0.21 | C | 3.4 | 0.28 | C |
| Example 20 | 1.8 | 0.20 | B | 3.5 | 0.30 | C |
| Comparative Example 1 | 1.6 | 0.26 | C | 4.2 | 0.34 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-096482, filed May 1, 2013, which is hereby incorporated by reference herein in its entirety.

What is claimed is:

1. A developer replenishing cartridge, comprising:

a developer replenishing container, and a developer, the developer replenishing cartridge being removably mountable to a developer replenishing apparatus;

wherein:

the developer replenishing container includes (i) a developer containing portion for containing the developer, (ii) a discharge port for discharging the developer contained in the developer containing portion, and (iii) a pump portion that operates so that a state where an internal pressure of the developer containing portion is lower than an atmospheric pressure and a state where the internal pressure is higher than the atmospheric pressure alternately repeatedly switch with each other;

the developer contains toner;

the toner includes toner particles each containing a binder resin and a wax, and silica fine particles present on surfaces of the toner particles;

the silica fine particles have a number-average particle diameter of primary particles of 60 nm or more and 300 nm or less;

a coverage rate of the surfaces of the toner particles with the silica fine particles is 15% or more and 95% or less;

the toner has a uniaxial collapse stress at a maximum consolidation stress of 10.0 kPa, of 2.5 kPa or more and 3.5 kPa or less; and the developer is contained in the developer containing portion of the developer replenishing container.

2. A developer replenishing cartridge according to claim 1, wherein the toner has a sticking ratio of the silica fine particles of 80 mass % or more with reference to a total amount of the silica fine particles.

3. A developer replenishing cartridge according to claim 1, wherein:

the developer comprises a two-component developer containing the toner and a carrier; and a content of the toner is 3.0 parts by mass or more and 30.0 parts by mass or less with respect to 1.0 part by mass of the carrier.

4. A developer replenishing cartridge according to claim 1, wherein the binder resin comprises a polyester resin having an acid value of 1 mgKOH/g or more and 20 mgKOH/g or less.

5. A developer replenishing cartridge according to claim 1, wherein a content of the wax is 0.5 part by mass or more and 20 parts by mass or less with respect to 100 parts by mass of the binder resin.

6. A developer replenishing cartridge according to claim 1, wherein the toner contains a polymer having a structure in which a vinyl-based resin component and a hydrocarbon compound react with each other.

7. A developer replenishing cartridge according to claim 6, wherein the polymer comprises one of (i) a graft polymer having a structure in which a polyolefin is grafted to the vinyl-based resin component, and (ii) a graft polymer having the vinyl-based resin component in which a vinyl-based monomer is subjected to graft polymerization with the polyolefin.

8. A developer replenishing cartridge according to claim 1, wherein the toner contains a coloring agent.

9. A developer replenishing cartridge according to claim 8, wherein a content of the coloring agent is 0.1 part by mass or more and 30 parts by mass or less with respect to 100 parts by mass of the binder resin.

10. A developer replenishing cartridge according to claim 1, wherein the silica fine particles are subjected to surface treatment with one of a silane coupling agent and a silicone oil.

11. A developer replenishing cartridge according to claim 10, wherein the silica fine particles are subjected to surface treatment with hexamethyldisilazane.

12. A developer replenishing method, comprising:

using a developer replenishing cartridge;

wherein:

the developer replenishing cartridge contains a developer replenishing container and a developer, the developer replenishing cartridge being removably mountable to a developer replenishing apparatus;

the developer replenishing container includes (i) a developer containing portion for containing the developer, (ii) a discharge port for discharging the developer contained in the developer containing portion, and (iii) a pump portion that operates so that a state where an internal pressure of the developer containing portion is lower than an atmospheric pressure and a state where the internal pressure is higher than the atmospheric pressure alternately repeatedly switch with each other;

the developer contains toner;

the toner includes toner particles each containing a binder resin and a wax, and silica fine particles present on surfaces of the toner particles;

the silica fine particles have a number-average particle diameter of primary particles of 60 nm or more and 300 nm or less;

a coverage rate of the surfaces of the toner particles with the silica fine particles is 15% or more and 95% or less;

the toner has a uniaxial collapse stress at a maximum consolidation stress of 10.0 kPa, of 2.5 kPa or more and 3.5 kPa or less; and the developer is contained in the developer containing portion of the developer replenishing container.

* * * * *